US007684746B2

(12) United States Patent
Asakura et al.

(10) Patent No.: US 7,684,746 B2
(45) Date of Patent: Mar. 23, 2010

(54) IMAGE FORMING APPARATUS HAVING FIXING DEVICE WITH EXTERNAL HEATER

(75) Inventors: Kenji Asakura, Kyoto (JP); Hiroyuki Yamaji, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 600 days.

(21) Appl. No.: 11/683,480

(22) Filed: Mar. 8, 2007

(65) Prior Publication Data

US 2007/0212094 A1 Sep. 13, 2007

(30) Foreign Application Priority Data

Mar. 13, 2006 (JP) ..... 2006-067292

(51) Int. Cl.
*G03G 15/20* (2006.01)

(52) U.S. Cl. ..... 399/330

(58) Field of Classification Search ..... 399/69, 399/328, 330, 331; 219/216
See application file for complete search history.

(56) References Cited

U.S. PATENT DOCUMENTS

| | | | | |
|---|---|---|---|---|
| 6,411,785 | B1 | 6/2002 | Ogawahara et al. | |
| 6,582,222 | B1 * | 6/2003 | Chen et al. | 432/60 |
| 6,799,000 | B2 * | 9/2004 | Aslam et al. | 399/45 |
| 7,194,233 | B2 * | 3/2007 | Wu et al. | 399/328 |
| 7,319,839 | B2 * | 1/2008 | Ishii et al. | 399/328 |
| 7,570,909 | B2 * | 8/2009 | Asakura et al. | 399/328 |
| 7,603,069 | B2 * | 10/2009 | Yamana et al. | 399/328 |
| 7,613,411 | B2 * | 11/2009 | Tateishi et al. | 399/69 |

FOREIGN PATENT DOCUMENTS

| | | | |
|---|---|---|---|
| JP | 2001-154529 | | 6/2001 |
| JP | 2003-295658 | | 10/2003 |
| JP | 2004-198659 | | 7/2004 |
| JP | 2005-241890 | | 9/2005 |
| JP | 2005-266415 | | 9/2005 |
| JP | 2005241785 | A * | 9/2005 |
| JP | 2006003415 | A * | 1/2006 |

* cited by examiner

*Primary Examiner*—Robert Beatty
(74) *Attorney, Agent, or Firm*—Renner, Otto, Boisselle & Sklar, LLP

(57) ABSTRACT

Support rollers suspending an endless belt are arranged so that a distance between each support roller and a fixing roller is smaller than a height of a belt regulating member provided on each side of the support roller in moving the support rollers to the second position which allows the endless belt to be in contact with the fixing roller so that a contact area therebetween is smaller than in the first position. As a result, in a fixing apparatus which includes the regulating member for regulating a position of an external heating belt in a rotational axis direction so that a contact area size between the external heating belt and the fixing member is variable, it is possible to appropriately vary the contact area between the belt and the fixing material.

26 Claims, 10 Drawing Sheets

FIRST POSITION

SECOND POSITION (SEPARATION DISTANCE IS LESS THAN 4 mm)

SECOND POSITION (SEPARATION DISTANCE IS NOT LESS THAN 4 mm)

IMAGE FORMING APPARATUS HAVING FIXING DEVICE WITH EXTERNAL HEATER

This Nonprovisional application claims priority under 35 U.S.C. § 119(a) on Patent Application No. 067292/2006 filed in Japan on Mar. 13, 2006, the entire contents of which are hereby incorporated by reference.

FIELD OF THE INVENTION

The present invention relates to (i) a fixing apparatus used in an electrophotographic image forming apparatus and (ii) an electrophotographic image forming apparatus using the fixing apparatus.

BACKGROUND OF THE INVENTION

Generally, as a fixing apparatus used in an electrophotographic image forming apparatus such as a copying machine, a printer, and the like, a heat roller type fixing apparatus is frequently used. The heat roller type fixing apparatus includes a fixing roller and a pressing roller which are pressed against each other, wherein heating means constituted of a halogen lamp (halogen heater) disposed in the fixing roller or halogen lamps (halogen heaters) disposed in both the rollers heats the pair of rollers at a predetermined temperature (fixing temperature), and a recording paper on which an unfixed toner image is formed is fed to a pressing section (fixing nip section) of the pair of rollers, and the recording paper is allowed to pass through the pressing section so as to fix the toner image by heat and pressure.

In a fixing apparatus provided in a color image forming apparatus, it is general to use an elastic roller having an elastic layer which is made of silicon rubber or the like and which is provided on a fixing roller surface layer.

The elastic roller is used as the fixing roller, so that the fixing roller surface is elastically deformed corresponding to an uneven surface of the unfixed toner image and is in contact with the toner image so as to cover the toner image. This allows the color unfixed toner image whose toner amount is larger than that of monochrome to be favorably heated and fixed. Further, due to strain release of the elastic layer which occurs in the fixing nip section, it is possible to improve a releasing property with respect to color toner which is more likely to be offset than monochrome toner. Further, a nip shape of the fixing nip section has a concave upward (on the side of the fixing roller) (that is, the nip shape is a so-called inverse nip shape), so that it is possible to more favorably strip paper. As a result, it is possible to strip paper without using any stripping means such as a stripping protrusion (self stripping), so that it is possible to prevent insufficient image formation which is caused by the stripping means.

Note that, an image forming apparatus using monochrome toner is also arranged so that the elastic layer is provided only on the pressing roller without being provided on the fixing roller so as to secure the fixing nip.

Incidentally, the fixing roller or the pressing roller which includes the elastic layer raises the following problem. In the fixing roller having the elastic layer, the elastic layer cannot sufficiently conducts heat. Thus, in case where the heating means is provided in the fixing roller, heat is less efficiently conducted, so that it takes longer time to warm up. In case of allowing sheets to sequentially pass at high speed, the temperature of the fixing roller drops.

As a method for solving these problems, a technique in which external heating means is brought into contact with the fixing roller surface so that the fixing roller is heated from the outside (external heat fixing process) is known.

For example, Patent Document 1 (Japanese Unexamined Patent Publication No. 198659/2004 (Tokukai 2004-198659) (Publication date: Jul. 15, 2004)) proposes a technique (an external belt heat fixing process) using an external heating belt (endless belt), suspended by belt suspending rollers, as external heating means. In this technique, the external heating belt is used as the external heating means, so that a contact area between the external heating means and the fixing roller increases, thereby promoting supply of heat from the external heating means to the fixing roller.

Further, Patent Document 2 (Japanese Unexamined Patent Publication No. 154529/2001 (Tokukai 2001-154529) (Publication date: Jun. 8, 2001)) discloses a technique in which: a roller (external heating roller) is used as the external heating member so as to change surface temperature of the external heating member and/or the fixing roller, a type of a transfer medium, and a timing at which the external heating member is brought into contact with the fixing roller surface in accordance with an image forming mode, thereby controlling the surface temperature of the fixing roller into a most suitable value.

However, in the technique of Patent Document 1, the external heating belt is heated by heating the belt suspending rollers and heat is supplied to the fixing member via the external heating belt, so that it is necessary to set temperature of each of the belt suspending rollers and the external heating belt to be higher than the surface temperature of the fixing roller. Thus, also after stopping the heating of the belt suspending rollers, each belt suspending roller has higher temperature than the surface temperature of the fixing roller for a while. As a result, when the rotation of the fixing roller is stopped at the time of fixing-standby after finishing the fixing, a contact portion between the fixing roller and the external heating belt (particularly, a portion being in contact with the belt suspending roller via the external heating belt) is locally heated, so that the surface of the fixing roller has uneven temperature, which results in uneven gloss of an image. Note that, Patent Document 1 describes an arrangement in which the external heating belt can be brought into contact with and can be separated from the fixing roller, but this arrangement is made in order to separate the external heating belt so that a jam process or belt cleaning can be carried out. Thus, separation carried out in order to control the temperature of the fixing roller is not described in Patent Document 1 at all.

Further, the fixing apparatus of Patent Document 2 is arranged so that the external heating roller can be separated from and can be brought into contact with the fixing roller. Thus, it is possible to separate the external heating roller from the fixing roller at the time of fixing-standby. However, in the technique of Patent Document 2, the roller is used as the external heating means, so that a contact area between the external heating means and the fixing roller is small, which results in such a problem that it is impossible to sufficiently supply heat to the fixing roller.

Thus, the fixing apparatus adopting the heat fixing method may be arranged so that the external heating belt can be separated from the fixing roller so as to control the surface temperature of the fixing roller. However, in the fixing apparatus adopting the heat fixing method, it is necessary to provide a regulating member for regulating side positions of the external heating belt (positions of both sides of the external heating belt which are in a rotational axis direction of the belt suspending roller) so as to stably rotate the external heating belt within a predetermined range with respect to an axis direction of the belt suspending roller.

However, it is general that the regulating member is provided so as to be integrally rotatable and movable with the belt suspending roller in order to prevent the external heating belt from receiving excessive stress caused by sliding against the regulating member. Further, each of the external heating belt and the belt suspending roller thermally extends and shrinks depending on temperature change at the time of fixing operation and at the time of fixing operation stoppage, so that the length of the belt suspending roller changes in its axis direction. Thus, the arrangement in which the external heating belt can be separated from the fixing roller in order to control the surface temperature of the fixing roller raises such a problem that: the regulating member moves to a position being contact with a peripheral surface of the fixing roller, so that it is impossible to suitably control relative positions of the fixing roller and the belt thereafter.

This problem is further detailed as follows. FIG. 10(*a*) illustrates an arrangement of an external heating device 100 in which a regulating member for regulating a side position of the belt is provided on the belt suspending roller so that the side position of the external heating belt is regulated. The external heating device 100 is arranged so that: an external heating belt 103 is suspended by two belt suspending rollers 101 and 102, and the external heating belt 103 is brought into contact with the fixing roller 109. On each side of the belt suspending roller 101, a belt regulating member 104 is provided. On each side of the belt suspending roller 102, a belt regulating member 105 is provided. Thus, when the external heating belt 103 moves in a rotational axis direction of each of the belt suspending rollers 101 and 102, sides of the external heating belt 103 are respectively brought into contact with the belt regulating members 104 and 105, so that movement of the external heating belt 103 is regulated.

In the external heating device 100, in case where the external heating belt 103 is separated from the fixing roller 109 as illustrated in FIG. 10(*b*), when a distance between each of the belt suspending rollers 101 and 102 and (ii) the fixing roller 109 is large, rotation of the external heating belt 103 causes the belt suspending rollers 101 and 102 to move in the rotational axis directions of both the rollers as illustrated in FIG. 10(*c*), which may cause the belt regulating members 104 and 105 to move to positions being contact with the peripheral surface of the fixing roller 109. In this case, even in case of trying to bring the belt suspending rollers 101 and 102 into contact with the fixing roller 109, the belt regulating member 104 intervenes between the belt suspending roller 101 and the fixing roller 109, and the belt regulating member 105 intervenes between the belt suspending roller 102 and the fixing roller 109, so that it is impossible to bring the external heating belt 103 into contact with the fixing roller 109. As a result, it is impossible to supply heat from the external heating belt 103 to the fixing roller 109.

Note that, in order to prevent such a problem, it may be so arranged that a distance between the belt regulating member 104 and the fixing member 109 is increased and a distance between the belt regulating member 105 and the fixing member 109 is increased as illustrated in FIG. 10(*d*). However, in this case, it is necessary to increase the width of the external heating belt 103 in the axis direction in order to stably rotate the external heating belt 103 within a predetermined range with respect to the axis directions of the belt suspending rollers 101 and 102. Thus, the external heating belt 103 has a wider area, which is not in contact with the fixing roller 109, in its each side. Further, the area does not allow heat to be conducted from the external heating belt 103 to the fixing roller 109, so that the area has extremely high temperature. As a result, thermal deterioration of the external heating belt 103 is accelerated, so that its durability drops. If the thermally deteriorated area comes into contact with each of the belt regulating members 104 and 105, the area is broken.

Further, when the external heating belt 103 is separated from the fixing roller 109 in an arrangement in which a center distance between the belt suspending roller 101 and 102 is fixed, a less tension is exerted to the external heating belt 103 as illustrated in FIG. 10(*b*), so that the suspended belt greatly deviates from a common tangent L of the belt suspending rollers 101 and 102 (the external heating belt 103 becomes loose). While, the external heating belt 102 is rotated by the fixing roller 109 while shifting from a contact state to a separation state, so that the external heating belt 103 is rotated in a loose state. As a result, the external heating belt 103 is likely to run upon the regulating members 104 and 105. If the external heating belt 103 run upon the regulating members 104 and 105, left tension and right tension of the external heating belt 103 (tension distribution of the belt suspending rollers 101 and 102 in the rotational axis direction) are uneven, so that a great deviation force in the axis direction is exerted to the external heating belt 103. As a result, the external heating belt 103 is broken.

Note that, in order to prevent the external heating belt 103 from being loose even in case where the external heating belt 103 is separated from the fixing roller 109, it may be so arranged that: the belt suspending roller 102 is used as a tension roller, and the center distance between the belt suspending rollers 101 and 102 is made variable so as to continuously exert a tension to the external heating belt 103. However, in this case, it is necessary to move the belt suspending roller 102 (tension roller) in separating the external heating belt 103, and it is necessary also to provide a mechanism for pressing the belt suspending roller 102. This results in a larger size of the fixing apparatus and in a more complicate structure of the apparatus.

Further, in order to solve the problems, it may be so arranged that the belt regulating member (snaking prevention rib) is provided on an internal peripheral surface of the external heating belt 103. However, in this case, it is necessary that the temperature of the external heating belt 103 is equal to or higher than the surface temperature of the fixing roller 109 in order to supply heat to the fixing roller 109, so that the snaking prevention rib is exposed to the high temperature. As a result, it is difficult to keep the adhesive strength for an extended period of time.

SUMMARY OF THE INVENTION

The present invention was made in view of the foregoing problems, and an object of the present invention is to appropriately vary a contact area between the external heating belt and the fixing member that are provided in a fixing apparatus, including a regulating member for regulating a position of the external heating belt in a rotational axis direction, wherein the contact area between the external heating belt and the fixing member is variable.

In order to solve the foregoing problems, a fixing apparatus of the present invention includes: a fixing member; a pressing member; and one or more external heating devices for heating and bringing a belt rotatably suspended by a plurality of support rollers into contact with a peripheral surface of the fixing member or the pressing member which serves as a heated member so as to heat the heated member, the fixing member and the pressing member transporting a recording material by sandwiching the recording material so that an unfixed image on the recording material is fixed onto the recording material with heat and pressure, said fixing apparatus comprising: a release/contact operating device for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position; and a regulating member which is provided on the support rollers so as to be positioned axially in an outside of a region facing to the heated member and is in contact with an edge portion of the belt for regulating a position in an axial direction of the belt, wherein when said at least one support roller is in the second position, the regulating member has a height from a surface of the region facing to the heated member on the support roller so that the height is longer than a distance between a surface of the support roller having the regulating member and a surface of the heated member.

According to the arrangement, the fixing apparatus includes the release/contact operating device for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position. As a result, it is possible to change the contact area (heating nip width) between the belt and the heated member, thereby controlling heat supplied from the external heating device to the heated member.

Further, according to the foregoing arrangement, the fixing apparatus includes the regulating member which is provided on the support rollers so as to be positioned axially in an outside of a region facing to the heated member. As a result, it is possible to regulate an axial position of the belt, thereby smoothly rotating the belt.

Further, the regulating member has a height from a surface of the region facing to the heated member on the support roller so that the height is longer than a distance between a surface of the support roller having the regulating member and a surface of the heated member. Thus, it is possible to prevent the regulating member from moving to the area opposite to the heated member and the support rollers, thereby appropriately controlling the contact area between the belt and the heated member.

Further, a fixing apparatus of the present invention may be arranged so as to include: a fixing member; a pressing member; and one or more external heating devices for heating and bringing a belt rotatably suspended by a plurality of support rollers into contact with a peripheral surface of the fixing member or the pressing member which serves as a heated member so as to heat the heated member, the fixing member and the pressing member transporting a recording material by sandwiching the recording material so that an unfixed image on the recording material is fixed onto the recording material with heat and pressure, said fixing apparatus comprising: a release/contact operating device for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position; and a regulating member which is provided on the support rollers so as to be positioned axially in an outside of a region facing to the heated member and is in contact with an edge portion of the belt for regulating a position in an axial direction of the belt, wherein: a center distance between the support rollers is fixed, and there are common tangent lines between a peripheral surface of the support roller having the regulating member and a peripheral surface of a support roller adjacently positioned on an upstream side of that support roller in a rotational direction of the belt so that one of the common tangent lines which is further away from the heated member is a common tangent line L, and the common tangent line L and the peripheral surface of the support roller having the regulating member have a tangent point P, and a distance in a direction perpendicular to the common tangent line L between the tangent point P and the belt in case where said at least one support roller is in the second position is smaller than a height of the regulating member which height extends from the tangent point P to the peripheral surface of the regulating member which is in the direction perpendicular to the common tangent line L.

According to the arrangement, the distance in a direction perpendicular to the common tangent line L between the tangent point P and the belt in case where said at least one support roller is in the second position is smaller than a height of the regulating member which height extends from the tangent point P to the peripheral surface of the regulating member which is in the direction perpendicular to the common tangent line L, so that it is possible to prevent the belt from running upon the regulating member even when the support rollers are moved with the belt rotated or even when the belt is rotated in the second position, thereby realizing appropriate rotation. Thus, it is possible to move the support rollers with the belt rotated, thereby adjusting heat supplied from the belt to the heated member at the same time as the image forming operation. Further, it is not necessary to stop rotation of the heated member in moving the support rollers, so that it is possible to keep the surface temperature of the heated member uniform.

An image forming apparatus of the present invention includes any one of the aforementioned fixing apparatuses. According to the arrangement, it is possible to appropriately control the temperature of the fixing apparatus.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*a*) illustrates a state in which support rollers are in a first position. FIG. 1(*b*) illustrates a state in which the support rollers are in a second position.

FIG. 4(*b*) is a cross sectional view of the belt release/contact operating device.

FIG. 5(*a*) illustrates a case where the support rollers are in the first position. FIG. 5(*b*) illustrates a case where an arm is moved by 1.5 mm from the first position. FIG. 5(*c*) illustrates a case where the arm is moved by 3.5 mm from the first position.

FIG. 6(*b*) illustrates a state in which the belt runs upon the regulating member when the support rollers are in the second position in the fixing apparatus according to one embodiment of the present invention.

FIG. 7(*a*) illustrates a case where the support rollers are in the first position. FIG. 7(*b*) illustrates a case where the arm is moved by less than 4 mm from the first position. FIG. 7(*c*) illustrates a case where the arm is moved by not less than 4 mm from the first position.

FIG. 8(*a*) illustrates a case where the support rollers are in the first position. FIG. 8(*b*) illustrates a case where the support rollers are in the second position. FIG. 8(*c*) illustrates a vicinity of a bearing of each support roller.

FIG. 9(*a*) illustrates a case where support rollers are in the first position. FIG. 9(*b*) illustrates a case where the support rollers are in the second position.

FIG. 10(*a*) illustrates a state in which the belt suspending rollers are in contact with a fixing roller. Each of FIGS. 10(*b*) and 10(*c*) illustrates a state in which the belt suspending rollers are separated from the fixing roller. Further, FIG. 10(*d*) illustrates an arrangement in which a distance between the regulating member and the fixing roller is increased in the conventional external heating device.

DESCRIPTION OF THE EMBODIMENTS

Embodiment 1

Figure 2:
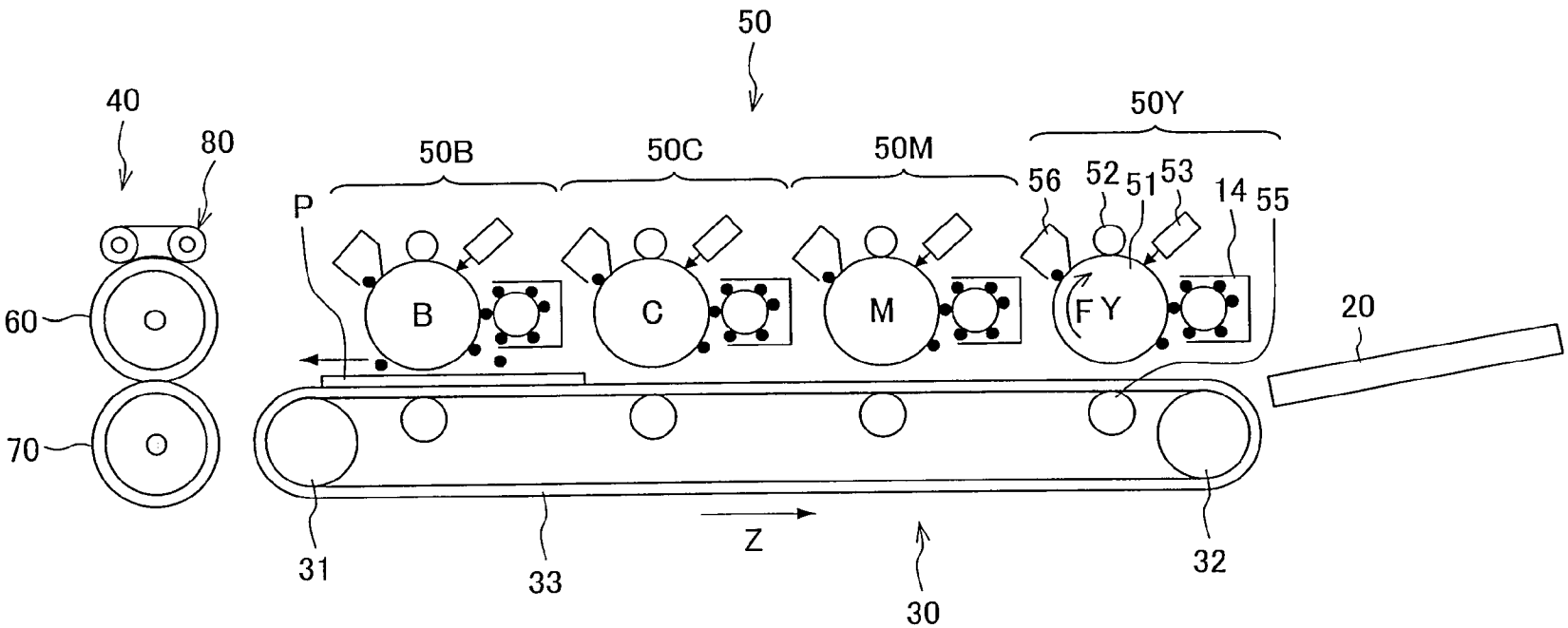
FIG. 2 illustrates an arrangement of an image forming apparatus including the fixing apparatus according to one embodiment of the present invention.

One embodiment of the present invention is described as follows. First, with reference to FIG. 2, an image forming apparatus 1 including a fixing apparatus of the present invention is described. FIG. 2 is a schematic illustrating an internal structure of the image forming apparatus 1. The image forming apparatus 1 is a dry electrophotographic color image forming apparatus and serves as a printer which for forming a color image or a monochrome image onto a sheet (recording sheet) P in accordance with image data sent from each terminal device connected via a network or image data scanned by a scanner.

The image forming apparatus 1 is a dry electrophotographic and quadruple tandem type color printer and includes a visible image transfer section 50, a sheet transport section 30, a fixing apparatus 40, a sheet feeding tray 20.

The visible image transfer section 50 includes an yellow image transfer section 50Y, a magenta image transfer section 50M, a cyan image transfer section 50C, and a black image transfer section SOB. These are specifically arranged as follows: between the sheet feeding tray 20 and the fixing apparatus 40, the yellow image transfer section 50Y, the magenta image transfer section 50M, the cyan image transfer section 50C, and the black image transfer section 50B are provided in this order from the side of the sheet feeding tray 20.

The transfer sections 50Y, 50M, 50C, and SOB are arranged substantially in the same manner, and respectively transfer an yellow image, a magenta image, a cyan image, and a black image onto the sheet P in accordance with the image data.

Each of the transfer sections 50Y, 50M, 50C, and 50B includes a photosensitive drum 51, and is arranged so that a charging roller 52, an LSU 53, a developing unit 54, a transfer roller 55, and a cleaning device 56 are provided around the photosensitive drum 51 so as to be along a rotational direction of the photosensitive drum 51 (direction F in FIG. 2).

The photosensitive drum 51 of each of the transfer sections 50Y, 50M, 50C, and 50B is a drum-shape transfer roller whose surface is made of a photosensitive material and is rotated in the direction F. The charging roller 52 uniformly (evenly) charges the surface of the photosensitive drum 51.

LSUs (laser beam scanner units) 53 of the transfer sections 50Y, 50M, 50C, and 50B respectively receive pixel signals corresponding to an yellow component, a magenta component, a cyan component, and a black component of the image data respectively. Each LSU 53 exposes the charged photosensitive drum 51 and forms an electrostatic latent image in accordance with each pixel signal.

Developing units 54 of the transfer sections 50Y, 50M, 50C, and 50B respectively include yellow toner, magenta toner, cyan toner, and black toner (developer). Further, each developing unit 54 develops the electrostatic latent image formed on the photosensitive drum 51 with the toner so as to form a toner image (visualized image). Note that, examples of the toner include nonmagnetic monocomponent developer (nonmagnetic toner), nonmagnetic bicomponent developer (nonmagnetic toner and carrier), magnetic developer (magnetic toner), and the like.

To each of transfer rollers 55 of the transfer sections 50Y, 50M, 50C, and 50B, a bias voltage whose polarity is opposite to the toner is applied, and the transfer roller 55 applies the bias voltage to the sheet P so as to transfer the toner image formed on the photosensitive drum 51 onto the sheet P. Each of cleaning devices 56 of the transfer sections 50Y, 50M, 50C, and 50B removes toner remaining on the photosensitive drum 51 after transferring the image onto the sheet P. This transfer of the toner image onto the sheet P is repeated four times corresponding to four colors.

The sheet transport section 30 includes a driving roller 31, an idling roller 32, and a transfer belt 33, and transports the sheet P so that the toner image is formed on the sheet P by the transfer sections 50Y, 50M, 50C, and 50B sequentially.

The driving roller 31 and the idling roller 32 suspend the transfer belt 33. The driving roller 31 is controlled so as to rotate at a predetermined peripheral speed (in the present embodiment, 355 mm/s in forming a monochrome image (monochrome mode) and 175 mm/s in forming a color image (color mode), so that the transfer belt 33 rotates.

The transfer belt 33 is suspended between the driving roller 31 and the idling roller 32 so as to be in contact with the photosensitive drums 51 of the transfer sections 50Y, 50M, 50C, and 50B, and the transfer belt 33 is frictionally driven in a direction Z by rollers 31 and 32. Further, the transfer belt 33 electrostatically adsorbs the sheet P transported from the sheet feeding tray 20 and transports the sheet P to the transfer sections 50Y, 50M, 50C, and 50B sequentially.

Further, the sheet P on which the toner image has been transferred by the transfer sections 50Y, 50M, 50C, and 50B is stripped from the transfer belt 33 due to a curvature of the driving roller 31 and is transported to the fixing device 40 (a chain line of FIG. 2 indicates a transport path). Note that, the toner image which has been transferred to the sheet P by the transfer sections 50Y, 50M, 50C, and 50B is still unfixed on the sheet P at this stage.

The fixing apparatus 40 thermally fixes the unfixed toner image, which has been transferred onto the sheet P, onto the sheet P. Specifically, the fixing apparatus 40 includes a fixing roller 60 and a pressing roller 70. The sheet P which has been transported from the visible image transfer section 50 at a predetermined fixing speed (process speed: 355 mm/s in the monochrome mode and 175 mm/s in the color mode) and a predetermined copying speed (the number of copied sheets in every one minute: 70 sheets/minute at the time of horizontal transport of A4 sheets in the monochrome mode, 40 sheets/minute at the time of horizontal transport of A4 sheets in the color mode) is transported into the fixing nip section N formed between the fixing roller 60 and the pressing roller 70. Further, the sheet P is further transported by the fixing roller 60 and the pressing roller 70 with it sandwiched by the fixing roller 60 and the pressing roller 70. At this time, the toner image (unfixed toner image) on the sheet P is fused by heat of a peripheral surface of the fixing roller 60 and is pressed by the fixing roller 60 and the pressing roller 70 so as to be fixed as a rigid image on the sheet P.

Further, the sheet P on which the toner image has been fixed by the fixing apparatus 40 is delivered to an external sheet delivery tray (not shown) of the image forming apparatus 1. In this manner, the image forming process is finished. Note that, a specific arrangement of the fixing apparatus 40 will be detailed later.

Further, the image forming apparatus 1 can carry out a color mode (multicolor mode) process in which the transfer sections 50Y, 50M, 50C, and 50B transfer an image onto the sheet P so as to form a color image (multicolor image) and can carry out a monochrome mode (black-and-white mode) process in which only the black transfer section 50B transfers an image onto the sheet P so as to form a monochrome image (black-and-white image). Specifically, in response to an instruction inputted by the user, a control section (a controlling integrated circuit substrate or a computer: not shown) provided in the image forming apparatus 1 selects either the color mode or the monochrome mode and controls the transfer sections 50Y, 50M, 50C, and 50B so as to carry out image formation according to the selected mode.

Further, the control section controls the transport means (the transport section 30, the fixing roller 60, the pressing roller 70, and the like) of the image forming apparatus 1 so as to transport the sheet P at a transport speed of 355 mm/s (referred to also as a process speed) in the color mode and so as to transport the sheet P at a transport speed of 175 mm/s in the monochrome mode.

Figure 3:
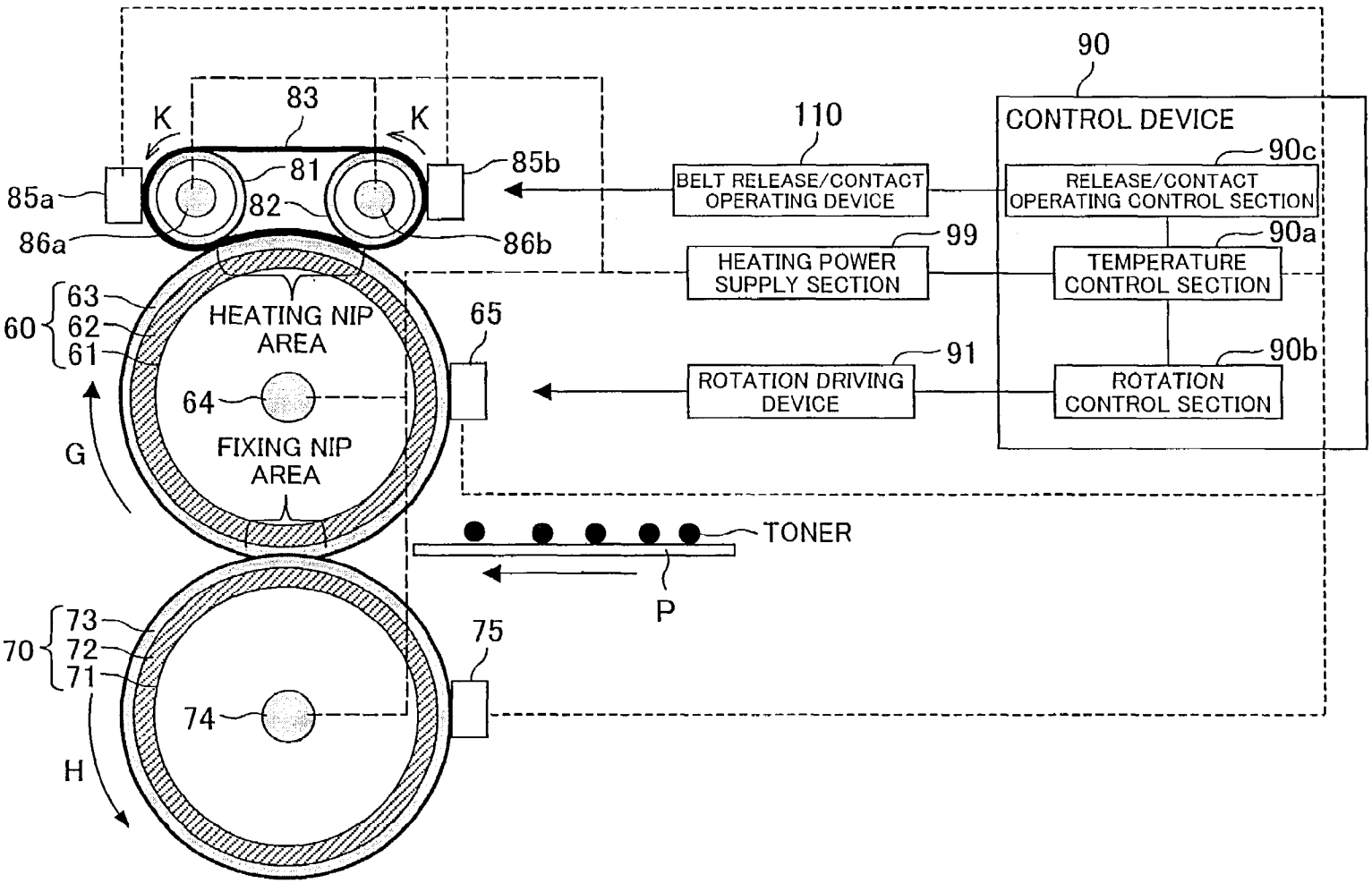
FIG. 3 illustrates an arrangement of the fixing apparatus according to one embodiment of the present invention.

Next, the fixing apparatus 40 is specifically described as follows. FIG. 3 is a schematic illustrating an arrangement of the fixing apparatus 40. The fixing apparatus 40 includes not only the aforementioned fixing roller (fixing member) 60 and pressing roller (fixing member) 70 but also an external heating device 80, a control device (control section) 90, a rotation driving device 91, and a belt release/contact operating device (release/contact operating device) 110. Note that, a web cleaning device and the like may be additionally provided so as to clean the surface of the fixing roller 60.

The rotation driving device 91 rotationally drives the fixing roller 60 and includes a motor and the like for example. Note that, operation of the rotation driving device 91 is controlled by the control device 90.

The fixing roller 60 is a roller which rotates in a direction G shown in FIG. 3, and includes a hollow cylindrical metal core 61, an elastic layer 62 covering an external peripheral surface of the core 61, and a releasing layer 63 covering the elastic layer 62.

The metal core 61 is made of aluminum whose external diameter is 46 mm and has a cylindrical shape. Note that, the metal core 61 is not limited to aluminum, and may be made of iron, stainless, and the like for example. The elastic layer 62 has the thickness of 3 mm and is made of silicon rubber having heat resistance (JIS-A hardness of 20). The releasing layer 63 is made of a PFA (copolymer of tetrafluoroethylene and perfluoroalkylvinylether) tube whose thickness is about 30 μm. Note that, the material of the releasing layer 63 is not particularly limited as long as the material has excellent heat resistance, durability, and releasing property with respect to the toner. Instead of PFA, a fluorine material such as PTFE (polytetrafluoroethylene) and the like may be used. The fixing roller 60 arranged in this manner has an external diameter of 50 mm, and a surface hardness of the fixing roller 60 is 68 (ascar C). Note that, the surface of the fixing roller 60 has a width of 320 mm in the rotational axis direction.

A thermistor (temperature detecting device) 65 for detecting temperature of a peripheral surface of the fixing roller 60 is in contact with the peripheral surface, and a halogen lamp (heater lamp) 64 for carrying out heat radiation by receiving power is provided in the metal core 61. The halogen lamp 64 serves as a heat source of the fixing roller 60. When power is supplied to the halogen lamp 64, the halogen lamp 64 heats the inside of the fixing roller 60 to a predetermined temperature (180° C. in the present embodiment) so as to heat the recording sheet which passes through the fixing nip section N and has the unfixed toner image thereon.

Note that, in the present embodiment, a single halogen lamp is internally provided, but the present invention is not limited to this arrangement. A plurality of halogen lamps whose heat generation distribution is divided in the axis direction may be used so that it is possible to realize optimal temperature distribution according to a sheet size for example. Further, in the present embodiment, the thermistor 65 is disposed so as to be in contact with a central portion of the fixing roller 60 so that the central portion is in a longer side direction, but the present invention is not limited to this arrangement. The thermistor 65 may be disposed in an end (an area where no sheet passes) of the fixing roller 60 so that the end is in the longer side direction. Further, in case where the central portion and the end portion are different from each other in a heat value because two halogen lamps are disposed or in a similar case, the thermistors may be provided on both the central portion and the end portion.

The pressing roller 70 is a roller which rotates in a direction H of FIG. 3 and includes a hollow metallic cylindrical metal core 71, an elastic layer 72 covering an external peripheral surface of the metal core 71, and a releasing layer 73 covering the elastic layer 72.

The metal core 71 has an external diameter of 46 mm and is made of aluminum. Note that, the metal core 71 is not limited to aluminum and may be made of iron, stainless, and the like. The elastic layer 72 is made of a silicon rubber whose thickness is 2 mm and which has heat resistance. The releasing layer 73 is made of a PFA tube whose thickness is about 30 μm. Note that, the material of the releasing layer 73 is not particularly limited as long as the material has excellent heat resistance, durability, and releasing property with respect to the toner. Instead of PFA, a fluorine material such as PTFE may be used. The pressing roller 70 arranged in this manner has an external diameter of 50 mm, and a surface hardness of the pressing roller 70 is 75 (ascar C).

The pressing roller 70 is pressed against the fixing roller 60 by an elastic member (spring: not shown) with a predetermined load (600N in this arrangement). As a result, a fixing nip section (a portion at which the fixing roller 60 and the pressing roller 70 are in contact with each other, the portion has a width of 9 mm in a sheet transport direction) is formed between the peripheral surface of the fixing roller 60 and the peripheral surface of the pressing roller 70. The pressing roller 70 is rotated by the fixing roller 60 so as to rotate in a direction opposite to a rotational direction of the fixing roller 60 (at the fixing nip section, moving directions of both the rollers are the same). Note that, in the present embodiment, the pressing roller 70 is rotated by the fixing roller 60, but the present invention is not limited to this arrangement. It may be so arranged that the pressing roller 70 is rotated by a rotation driving device which is different from the fixing roller 60.

Further, a thermistor (temperature detecting device) 75 for detecting temperature of a peripheral surface of the pressing roller 70 is in contact with the peripheral surface, and a halogen lamp (heater lamp) 74 for carrying out heat radiation by receiving power is provided in the metal core 71. The halogen lamp 74 serves as a heat source of the pressing roller 70. When power is supplied to the halogen lamp 74, the inside of the pressing roller 70 is heated to a predetermined temperature (150° in the present embodiment).

Note that, in the present embodiment, a rubber hardness (75) of the pressing roller 70 is higher than a rubber hardness (68) of the fixing roller 60. This arrangement is made so that the fixing nip section N formed between the pressing roller 70 and the fixing roller 60 has an inverse nip shape (the shape of the pressing roller 70 hardly changes and the fixing roller 60 has a slightly concave shape). A nip width of the fixing nip section N obtained in this manner is 8.5 mm.

A reason for which the fixing nip section N between the pressing roller 70 and the fixing roller 60 has the inverse nip shape is explained as follows. In case where the fixing nip section N has the inverse nip shape, the sheet P passing through the fixing nip section N is delivered in a direction along the peripheral surface of the pressing roller 70, so that the sheet P is more easily stripped by itself in being delivered from the fixing nip section N (the sheet P is more likely to be stripped due to its elasticity without using any forcible stripping auxiliary means such as a stripping protrusion).

Note that, if the surface hardness of the pressing roller 70 is lower than the surface hardness of the fixing roller 60, the fixing nip section N between the fixing roller 60 and the pressing roller 70 is in such a state that the shape of the fixing roller 60 hardly changes and the pressing roller 70 has a slightly concave shape, and the sheet P passing through the fixing nip section N is delivered in a direction along the peripheral surface of the fixing roller 60. As a result, the self stripping hardly occurs.

The external heating device 80 includes a first support roller (first heating roller) 81, a second support roller (second heating roller) 82, an endless belt (external heating belt) 83, a belt release/contact operating device 110 (not shown in FIG. 3), and belt regulating members 121 and 122 (not shown in FIG. 3). The endless belt 83 is suspended by the support rollers 81 and 82 so that its rear side (internal peripheral surface) is in contact with peripheral surfaces of the support rollers 81 and 82. The endless belt 83 is provided on the fixing roller 60 so as to be positioned in the upstream side of the fixing nip section. When the support rollers 81 and 82 are in a below-described first position, the endless belt 83 is pressed against the fixing roller 60 with a predetermined pressure (40N in the present embodiment). Thus, a heating nip section (a contact portion between the endless belt 83 and the fixing roller 60: the fixing roller 60 has a width of 20 mm in a circumferential direction) is formed between the fixing roller 60 and the endless belt 83.

Further, the endless belt 83 comes into contact with the peripheral surface of the rotating fixing roller 60, so that the endless belt 83 is rotated by the fixing roller 60. As a result, the support rollers 81 and 82 rotate in a direction (direction K of FIG. 3) opposite to the rotational direction of the fixing roller 60. That is, when the control device 90 controls the rotation driving device 91 of the fixing roller 60 so as to rotate the fixing roller 60, a frictional force at a portion in which the endless belt 83 and the fixing roller 60 are in contact with each other causes the endless belt 83 to be moved by the fixing roller 60, so that the support rollers 81 and 82 and the endless belt 83 rotate.

The endless belt 83 is obtained by coating a surface of a polyimide base material (product of UBE INDUSTRIES, LTD., product name: Upilex S), whose thickness is 90 μm, with a fluorine resin obtained by blending PETE and PFA with each other as a releasing layer whose thickness is 20 μm. Note that, the arrangement of the endless belt 83 is not limited to this, and a belt material made of metal such as nickel, stainless, iron, and the like may be used. Further, the internal diameter of the endless belt 83 is not limited to 30 mm. Note that, the material of the releasing layer of the endless belt 83 is not particularly limited as long as the material has excellent heat resistance, durability, and releasing property with respect to the toner. For example, PTFE or PFA may be independently used. Note that, the internal diameter of the endless belt 83 is 30 mm (internal peripheral length is 94 mm) at room temperature (20° C.)

Further, a width of the endless belt 83 (width of the support rollers 81 and 82 in the axis direction) is 320 mm at room temperature. However, a thermal expansion coefficient of polyimide is $5.6\times10^{-5}$/deg, so that temperature rise of 200 deg causes the endless belt 83 to thermally expand by about 3.6 mm (320 mm$\times5.6\times10^{-5}$/deg$\times$200 deg is substantially equal to 3.6) in the axis direction. Thus, the belt width at 220° C. which is a temperature set in carrying out the fixing operation of the endless belt 83 is 323.6 mm.

Each of the support rollers 81 and 82 is obtained by coating a surface of an aluminum metal core, whose external diameter is 15 mm and thickness is 2 mm, with a fluorine resin obtained by blending PTFE and PFA as a releasing layer and having the thickness of 20 μm. Note that, the material of the releasing layer is not particularly limited as long as the material has excellent heat resistance, durability, and releasing property with respect to the toner. For example, a fluorine material such as PFA, PTFE (polytetrafluoroethylene), and the like may be used. Further, the width of the support rollers 81 and 82 (contact area between each of the support rollers 81 and 82 and the fixing roller 60) in the axis direction is 320 mm at room temperature, and a center distance between the support rollers 81 and 82 is 23.0 mm.

Note that, a thermal expansion coefficient of aluminum is $2.4\times10^{-5}$/deg. Thus, in case where the support rollers 81 and 82 are heated to 220° C. (in case where temperature rise is 200 deg), the width of the support rollers 81 and 82 thermally expands by 1.5 mm.

Further, the support rollers 81 and 82 are pressed against the peripheral surface of the fixing roller 60 via the endless belt 83 by a below-described belt release/contact operating device 110 with a predetermined load. As a result, the surface of the endless belt 83 comes into contact with the peripheral surface of the fixing roller 60, and a nip section is formed between the surface of the endless belt 83 and the peripheral surface of the fixing roller 60. Note that, the nip width between the surface of the endless belt 83 and the peripheral surface of the fixing roller 60 is 20 mm (width along the peripheral direction of the fixing roller 60).

A thermistor (temperature detecting device) 85*a* for detecting surface temperature of the endless belt 83 is in contact with an external face of a contact area between the endless belt 83 and the first support roller 81. Further, a halogen lamp (heater lamp: temperature detecting device) 86*a* which generates heat by receiving power is provided in the first support roller 81. A thermistor (temperature detecting device) 85*b* for detecting surface temperature of the endless belt 83 is in contact with an external face of a contact area between the endless belt 83 and the second support roller 82. A halogen lamp (heater lamp: temperature detecting device) 86*b* which generates heat by receiving power is provided in the second support roller 82. Each of the halogen lamps 86*a* and 86*b* serves as a heat source of the endless belt 83. When power is supplied to the halogen lamps 86*a* and 86*b*, the halogen lamps 86*a* and 86*b* radiate heat so as to heat the endless belt 83 via the support rollers 81 and 82 to a predetermined temperature (220° C. in the present embodiment). The endless belt 83 is in contact with the peripheral surface of the fixing roller 60 from the outside of the fixing roller 60, so that it is possible to heat the peripheral surface of the fixing roller 60 via the contact area. In the present embodiment, the two support rollers 81 and 82 each of which is thin and has a small diameter and the endless belt 83 are used, so that it is possible to quickly raise temperature of the endless belt 83.

Figure 1:
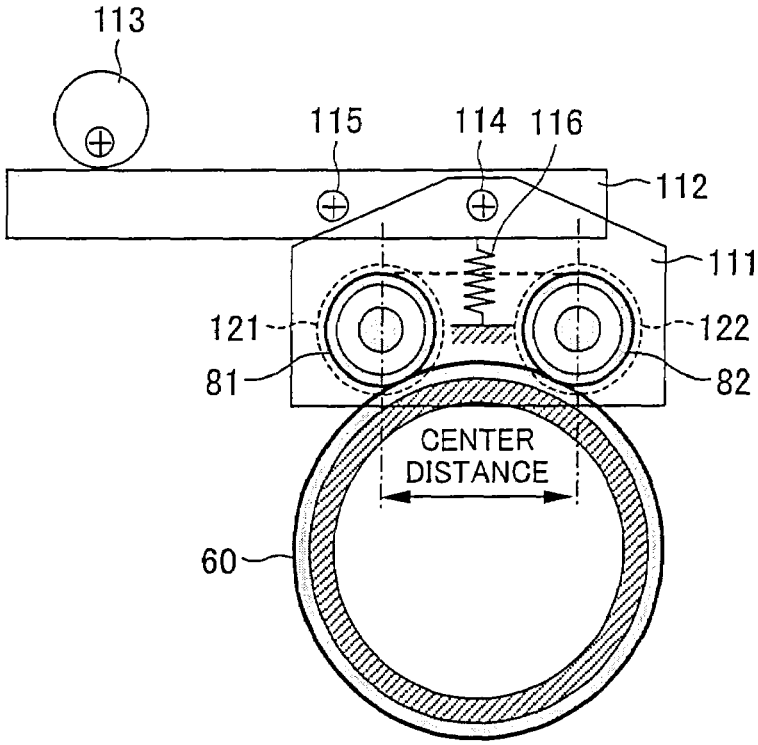
FIG. 1(*a*) and FIG. 1(*b*) are explanatory drawings each of which illustrates a fixing apparatus according to one embodiment of the present invention.
Figure 1:
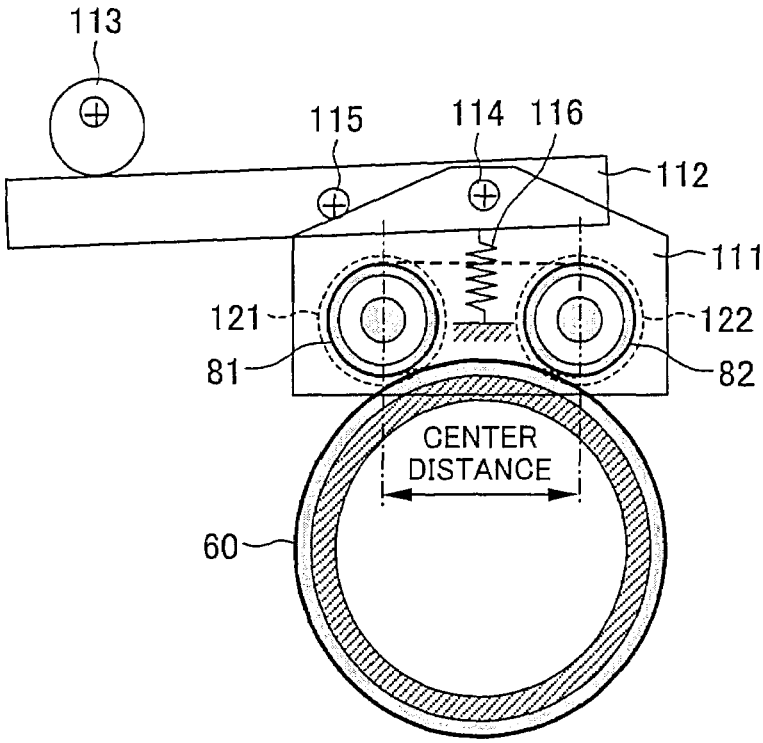
Figure 4:
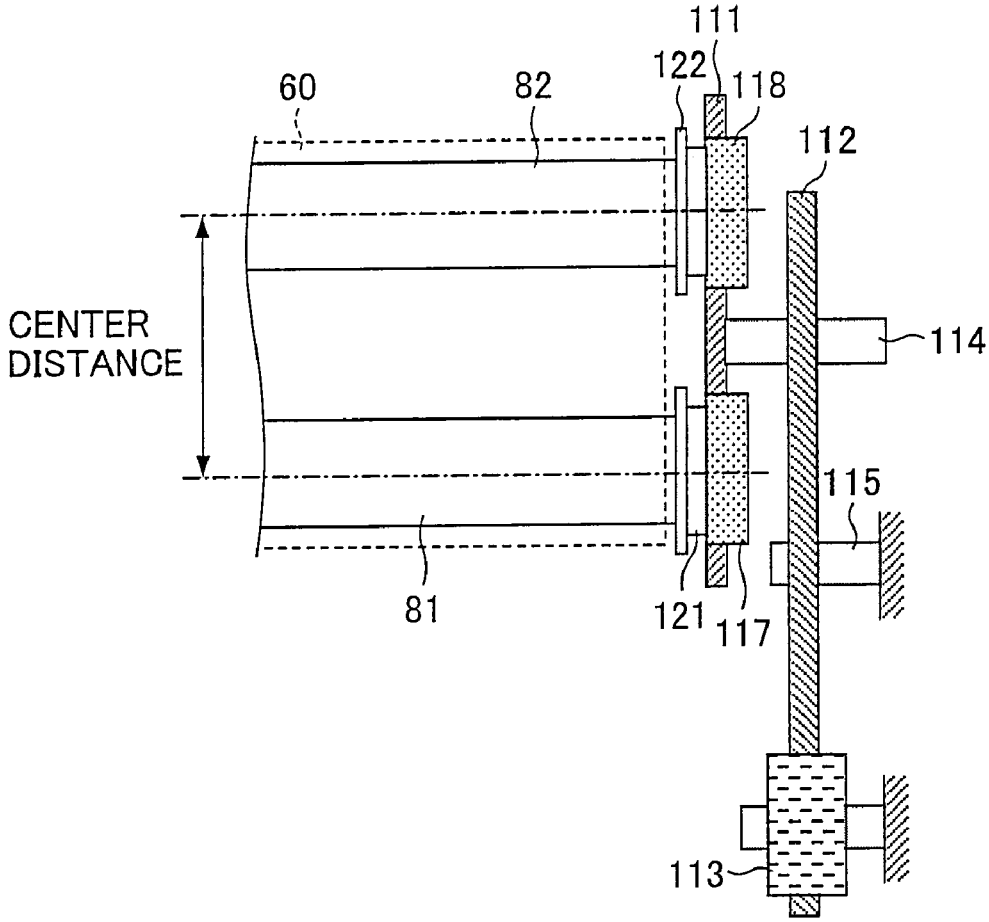
FIG. 4(*a*) is a top view illustrating an arrangement of a belt release/contact operating device provided on the fixing apparatus according to one embodiment of the present invention.
Figure 4:
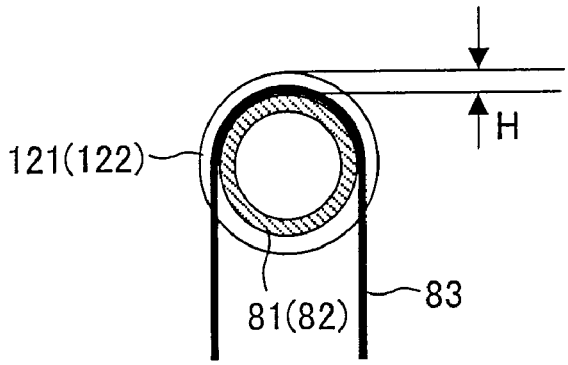

Next, the following will explain the belt release/contact operating device 110 and the belt regulating members 121 and 122 which are provided in the fixing apparatus 40. FIG. 1(*a*) is a cross sectional view illustrating a state in which the belt release/contact operating device 110 carries the support rollers 81 and 82 to a position (first position) which allows the support rollers 81 and 82 to be in contact with the fixing roller 60 via the endless belt 83. FIG. 1(*b*) is a cross sectional view illustrating a state in which the belt release/contact operating device 110 carries the support rollers 81 and 82 to a position (second position) in which the support rollers 81 and 82 are separated from the fixing roller 60. Further, FIG. 4(*a*) is a top view illustrating an arrangement of the belt release/contact operating device 110. FIG. 4(*b*) is a cross sectional view illustrating arrangements of the support roller 82, the endless belt 83, and the belt regulating member 122.

As illustrated in FIG. 1(*a*) and FIG. 1(*b*), the belt release/contact operating device 110 includes a side frame 111, an arm 112, an eccentric cam 113, a fulcrum (fulcrum member) 114, a fulcrum (fulcrum member) 115, and a coil spring 116.

The side frame 111 is provided on each side of the support rollers 81 and 82 and holds the support rollers 81 and 82 rotatably via bearings 117 and 118 as illustrated in FIG. 4(*a*). Note that, the bearings 117 and 118 are fixed on the side frame 111 with a predetermined center distance therebetween. This allows the support rollers 81 and 82 to be parallel to each other (in the present embodiment, a common difference between the support rollers 81 and 82 in view of the parallelism is not more than 100 μm). Further, a distance between the bearings 117 and 117 which are provided on both ends of the support roller 81 is 331 mm, and also a distance between the bearings 118 and 118 which are provided on both ends of the support roller 82 is 331 mm.

The side frame 111 is supported by the fulcrum 114 of the arm 112 so as to be rotatable in a substantially perpendicular direction with respect to the axis direction of the support rollers 81 and 82.

The arm 112 is rotatably supported by the fulcrum 115 fixed on a frame of the fixing apparatus 40 (not shown), and the arm 112 is pressed toward the fixing roller 60 by the coil spring 116 with the fulcrum 115 serving as an axis.

The eccentric cam 113 is provided so as to be in contact with a vicinity of an end portion of the arm 112. The control device 90 controls driving means such as a motor (not shown) and the like, so that the eccentric cam 113 is rotated.

As a result, the control device 90 (moving control section 90*c*) controls the driving means so as to rotate the eccentric cam 113, thereby moving the support rollers 81 and 82 to the first position as illustrated in FIG. 1(*a*) or the control device 90 further rotates the eccentric cam 113 at 180°, thereby moving the support rollers 81 and 82 to the second position as illustrated in FIG. 1(*b*).

Note that, a distance between the fulcrum 114 in the first position and the peripheral surface of the fixing roller 60 is 28 mm, and a distance between the fulcrum 114 in the second position and the peripheral surface of the fixing roller 60 is 29.5 mm. That is, in case of moving the support rollers 81 and 82 from the first position to the second position, a distance by which the fulcrum 114 is moved (separation length) is 1.5 mm. Further, a distance between the fulcrum 114 and the fulcrum 115 is 15 mm, and a distance between (i) a contact portion between the arm 112 and the eccentric cam 113 and (ii) the fulcrum 115 is 15 mm (thus, a lever ratio is 1:1). Thus, also a distance by which the contact portion between the arm 112 and the eccentric cam 113 is moved is 1.5 mm.

Further, a rotational direction contact width (heating nip width) of the endless belt 83 and the fixing roller 60 in stopping the rotation of the fixing roller 60 in the second position is about 10 mm. However, the contact width is a value which can be varied depending on a curving property and temperature of the endless belt 83. Generally, when the belt is heated, the peripheral length of the belt expands, so that the contact width increases. Note that, the separation length is 1.5 mm in the present embodiment, but in case where the separation length is set to be 4 mm, the endless belt 83 and the fixing roller 60 are completely separated from each other without being contact with each other by moving the endless belt 83 to the second position.

Note that, as illustrated in FIG. 4(*a*) and FIG. 4(*b*), the belt regulating member 121 is provided between the support roller 81 and the bearing 117, and the belt regulating member 122 is provided between the support roller 82 and the bearing 118. The belt regulating members 121 and 122 prevent the snaking endless belt 83 from deviating in the axis direction of the support rollers 81 and 82 by rotating while being in contact with a side portion of the belt. At the same time, the regulating members 121 and 122 prevent the side portion of the endless belt 83 from being in friction with the bearings 117 and 118, thereby preventing abrasion or breakage of the endless belt 83.

The belt regulating members 121 and 122 are respectively rotatable around the support rollers 81 and 82 (the belt regulating members 121 and 122 can respectively rotate around rotational axes of the support rollers 81 and 82 independently from rotation of the support rollers 81 and 82), and the belt regulating members 121 and 122 are movable also in the axis direction of the support rollers 81 and 82 independently from the support rollers 81 and 82. Further, as illustrated in FIG. 4(*b*), a cross sectional shape of each of the belt regulating members 121 and 122 in the axis direction of each of the support rollers 81 and 82 is a concentric circle with respect to a circle of a cross section of each of the support rollers 81 and 82, and each belt regulating member is provided so that its height H (mm) from the peripheral surface (belt suspending face) of each support roller is 2.5 mm.

Further, each of the support rollers 81 and 82 has the thickness of 3 mm of the axis direction in a portion corresponding to each of the belt regulating members 121 and 122. Thus, as described above, the fixing roller 60 has the width of 320 mm in the axis direction, and the endless belt 83 has the width of 320 in the axis direction at room temperature and has the width of 323.6 mm in the axis direction at 220° C., and the distance between the bearings 117 and the bearings 118 is 331 mm, so that a width of a portion of the endless belt 83 which portion is not in contact with the peripheral surface (fixing face) of the fixing roller 60 is up to 5 mm.

The control device 90 includes a temperature control section 90*a*, a rotation controlling section 90*b*, and a moving control section 90*c*, and serves as a control integrated circuit substrate which controls surface temperature of the endless belt 83, surface temperature of the fixing roller 60, surface temperature of the pressing roller 70, rotation driving of the fixing roller 60, movement of a belt position which is carried out by the belt release/contact operating device 110.

The temperature control section 90*a* is connected to the thermistors 65, 75, 85*a*, 85*b*, and a heating power supply section 99. The heating power supply section 99 is connected to the halogen lamps 64, 74, 86*a*, and 86*b* so as to supply power to the halogen lamps so that the halogen lamps generate heat. Further, the temperature control section 90*a* switches power, supplied from the heating power supply section 99 to the halogen lamps, in accordance with temperature detection results of the thermistors 65, 75, 85*a*, and 85*b*, an image formation mode, and the like, so as to control heat of the halogen lamps, thereby controlling temperatures of the endless belt 83, the fixing roller 60, and the pressing roller 70 to be predetermined temperatures.

The rotation control section 90*b* is connected to the rotation driving device 91 for rotating the fixing roller 60. The rotation control section 90*b* controls a rotation speed of the fixing roller 60 by controlling operation of the rotation driving device 91.

The moving control section 90*c* is connected to the belt release/contact operating device 110 and controls relative positions of the support rollers 81 and 82 and the fixing roller 60 that are provided in the external heating device 80 by controlling operation of the eccentric cam 113 provided on the belt release/contact operating device 110, so as to change the contact width (heating nip width) between the endless belt 83 and the fixing roller 60, thereby controlling heat supplied from the external heating device 80 to the fixing roller 60.

Further, the control device 90 controls the support rollers 81 and 82 between the first and second positions in accordance with a type of a transfer medium (recording sheet) or an image formation mode (a case of a monochrome image formation mode or a case of a color image formation mode, or a case of feeding a single sheet or a case of sequentially feeding plural sheets) and controls a contact area (heating nip width) of the endless belt 83, thereby controlling heat supplied from the external heating device 80 to the fixing roller 60.

In case of dropping the copying speed, the moving control section 90*c* moves the support rollers 81 and 82 from the first position to the second position. For example, in case where a sheet transport speed in the monochrome mode is set to 355 mm/s, and a sheet transport speed in the color mode is set to 175 mm/s, and a fixing roller set temperature in the monochrome mode and a fixing roller set temperature in the color mode are 180° C., and the heating nip width between the endless belt 83 and the fixing roller 60 is 20 mm, when the temperature of the endless belt 83 is set to 220° C. in the monochrome mode and is set to 205° C. in the color mode, heat which shifts to the sheet is substantially equal to heat supplied from the external heating device 80 to the fixing roller 60.

Thus, in case of changing the mode from the monochrome mode to the color mode, the temperature of the endless belt 83 is much higher than the set temperature. If a color image is fixed with excessively high temperature of the endless belt 83, the temperature of the fixing roller 60 becomes excessively high, so that the color image becomes excessively glossy or the gloss becomes uneven, which results in a low quality image. In order to avoid such problem, it may be so arranged that no operation is carried out until the temperature of the endless belt 83 drops to a predetermined temperature in shifting from the monochrome mode to the color mode. However, it takes 30 seconds or longer for the temperature of the endless belt 83 to drop from 220° C. to 205° C., so that it is impossible to smoothly shift from the monochrome mode to the color mode. As a result, waiting time occurs.

Thus, in the present embodiment, the moving control section 90*c* controls the relative positions of the support rollers 81 and 82 with respect to the fixing roller 60 (for example, the moving control section 90*c* mechanically moves the support rollers 81 and 82 from the first position to the second position) so as to reduce a contact area between the endless belt 83 and the fixing roller 60, thereby suppress heat supply from the external heating device 80 to the fixing roller 60.

Further, in sequentially feeding sheets, the moving control section 90*c* increases the contact area between the endless belt 83 and the fixing roller 60 in order to increase heat supplied from the external heating device 80 to the fixing roller 60 so that heat shifted to the sheets is compensated for.

In order to unify peripheral direction temperature distribution of the fixing roller 60 right after starting the image formation operation, the fixing roller 60 is heated and rotated, but no recording sheet passes through the fixing nip, so that heat does not shift from the fixing roller 60 to the recording sheet. When the support rollers 81 and 82 are in the first position under this condition, heat is excessively supplied from the endless belt 83 to the fixing roller 60, so that the temperature of the fixing roller 60 becomes higher than the set temperature. Thus, in order to prevent heat from being excessively supplied to the fixing roller 60, the moving control section 90*c* controls the belt release/contact operating device 110 so as to reduce the contact area between the endless belt 83 and the fixing roller 60, thereby changing heat supplied from the external heating device 80 to the fixing roller 60 in short time.

Further, at the time of standby upon finishing the image forming operation (in leaving the apparatus as it is), the moving control section 90*c* moves the support rollers 81 and 82 to the second position in order to prevent unevenness of temperature in a peripheral direction of the fixing roller 60. That is, the moving control section 90*c* moves the support rollers 81 and 82 to the second position after carrying out the image forming operation and moves the support rollers 81 and 82 to the first position according to a timing at which the recording sheet right after staring the image forming operation reaches the fixing nip.

Note that, the moving control section 90*c* may control the relative positions of the support rollers 81 and 82 with respect to the fixing roller 60 so that the support rollers 81 and 82 are disposed in any positions between the first position and the second position in accordance with temperatures of respective members, a type of the transfer medium (recording sheet), the image formation mode, and the like.

As described above, the fixing apparatus 40 according to the present embodiment is arranged so that: the height H from each of the peripheral surfaces (each contact face with respect to the fixing roller 60) of the support rollers 81 and 82 at positions corresponding to the belt regulating members 121 and 122 respectively provided on ends of the support rollers 81 and 82 is lower than a distance between the peripheral surface of each of the support rollers 81 and 82 in the second position and the fixing roller 60. That is, the distance by which the fulcrum 114 of the belt release/contact operating device 110 is moved from the first position to the second position is 1.5 mm, so that the distance between each of the support rollers 81 and 82 in the second position and the fixing roller 60 is shorter than 1.5 mm and is shorter than the height (2.5 mm) of the belt regulating members 121 and 122.

As a result, the distance between each of the support rollers 81 and 82 and the fixing roller 60 is shorter than the height H of the belt regulating members 121 and 122 at all times regardless of the position to which the support rollers 81 and 82 are moved by the belt release/contact operating device 110, so that it is possible to prevent the belt regulating members 121 and 122 from moving to the contact area between the support rollers 81 and 82 and the fixing roller 60.

Particularly, if the temperature of the endless belt 83 drops with the support rollers 81 and 82 separated from the fixing roller 60, the endless belt 83 and the support rollers 81 and 82 shrink, and the thermal shrinkage causes the relative positions of the belt regulating members 121 and 122 on the support rollers 81 and 82 with respect to the fixing roller 60 to change. Thus, in case of greatly separating the support rollers 81 and 82 from the fixing roller 60, if the height of the belt regulating members 121 and 122 is lower than the distance between the fixing roller 60 and each of the support rollers 81 and 82, the belt regulating members 121 and 122 may move to a position in which they are in contact with the peripheral surface of the fixing roller 60. Thus, it is preferable that the distance between the fixing roller 60 and each of the support rollers 81 and 82 in the second position is smaller than the height H of the belt regulating members 121 and 122 under such condition that the temperature of the endless belt 83 is lower than the temperature at the time of the fixing operation.

Note that, in the present embodiment, the belt release/contact operating device 110 causes both the support rollers 81 and 82 to move relative to the fixing roller 60. However, the present invention is not limited to this arrangement, and at least one support roller moves relative to the fixing roller 60 so as to change a contact face (heating nip width) between the endless belt 83 and the fixing roller 60. Further, the present embodiment described the arrangement in which two support rollers are provided, but the present invention is not limited to this arrangement. It may be so arranged that three or more support rollers are provided.

Further, in the present embodiment, the belt regulating members are respectively provided on the support rollers 81 and 82, but the present invention is not limited to this arrangement. However, in case where the distance between the support roller having the belt regulating member in the first position and the fixing roller is smaller than the height of the belt regulating member, it is preferable to set the distance between the support roller and the fixing roller to be smaller than the height of the belt regulating member also in the second position.

Further, in the present embodiment, a width of a portion of the endless belt 83 which portion is not in contact with the peripheral surface (fixing face) of the fixing roller 60 (the width corresponds to deviation of the endless belt 83 axially deviating from a part opposite to the fixing roller 60) is up to 5 mm. That is, also in case where the endless belt 83 is heated to the set temperature at the time of the fixing operation and thermally expands, a width of a portion on the peripheral surface of the endless belt 83 which portion is not in contact with the fixing roller 60 is not more than 5 mm in the axis direction.

In case where an area on the peripheral surface of the external heating belt which area is not in contact with the fixing roller is large, this area does not allow heat to be conducted to the fixing roller, so that the temperature of the area is extremely high. As a result, thermal deterioration of the external heating belt is accelerated, so that the durability drops, which results in breakage of the external heating belt in coming into contact with the belt regulating member. While, in the fixing apparatus 40 according to the present embodiment, a width of a portion of the endless belt 83 which portion is not in contact with the peripheral surface of the fixing roller 60 is not more than 5 mm, so that excessive temperature rise of the non-contact portion is suppressed, thereby sufficiently keeping the durability of the endless belt 83. That is, if the width of the portion of the endless belt 83 which portion is not in contact with the peripheral surface of the fixing roller 60 is not more than 5 mm, it is possible to suppress excessive temperature rise of the endless belt 83, thereby keeping the durability.

Further, in the present embodiment, the belt regulating members 121 and 122 can rotate in a rotational direction of the endless belt 83.

In case where the rotation of the external heating belt is constrained, a side portion of the belt is continuously in friction with a portion of the belt regulating member, so that a groove corresponding to the thickness of the side portion of the belt is formed on the belt regulating member. Further, the belt rotates while cutting into the groove, so that an excessive stress is exerted to the belt. As a result, the durability of the belt drops. While, in the present embodiment, the belt regulating members 121 and 122 can rotate in the moving direction of the belt, so that it is possible to prevent the endless belt 83 from being in friction with only one portion of each of the belt regulating members 121 and 122, thereby preventing formation of the groove. As a result, it is possible to prevent the durability of the endless belt 83 from dropping.

Further, in the present embodiment, the belt regulating members 121 and 122 can move relative to the support rollers 81 and 82 in the axis direction of the support rollers 81 and 82. Specifically, axial positions of the belt regulating members 121 and 122 are defined by support members (the bearings 117 and 118, the side frame 112) for supporting the support rollers 81 and 82. Each of the support members does not have high temperature unlike the endless belt 83 and is less deformed by heat, so that it is possible to define a width direction position of the endless belt 83 without depending on axial deviation of the support rollers 81 and 82 and the thermal expansion. Thus, it is possible to accurately position the fixing roller 60 and the endless belt 83 relative to each other.

Further, in the present embodiment, when the separation distance of the fulcrum 114 in the second position is set to 2 mm so as to move the support rollers 81 and 82 to the second position, upper portions of the endless belt 83 slightly rise from the surfaces of the support rollers 81 and 82 so as to deviate from a junction between (i) an outside common tangent (a common tangent further away from the fixing roller 60 which common tangent is in a cross sectional face perpendicular to the axis direction of the support rollers 81 and 82) L of the support rollers 81 and 82 and (ii) a tangent point P of the support rollers 81 and 82 so that the deviation corresponds to a distance (distance in a direction perpendicular to the common tangent line L of the support rollers 81 and 82) smaller than the height H of the belt regulating members 121 and 122. As a result, in case where the endless belt 83 rotates in the second position or during transition from the first position to the second position, it is possible to prevent the endless belt 83 from running upon the belt regulating members 121 and 122. Thus, even if the support rollers 81 and 82 are moved while rotating the endless belt 83, no problem occurs in the rotation, so that it is possible to control heat supplied to the fixing roller 60 by changing the contact width (heating nip width) between the endless belt 83 and the fixing roller 60 at the same time as the image formation operation. Further, it is not necessary to stop the rotation of the fixing roller 60 in moving the support rollers 81 and 82, so that it is possible to keep the surface temperature of the fixing roller 60 uniform.

The endless belt 83 rises so as to deviate from the tangent point P by a distance smaller than the height H of the belt regulating members 121 and 122, so that it is possible to prevent the endless belt 83 from running upon the belt regulating members 121 and 122. A reason for this will be detailed as follows.

Figure 5:
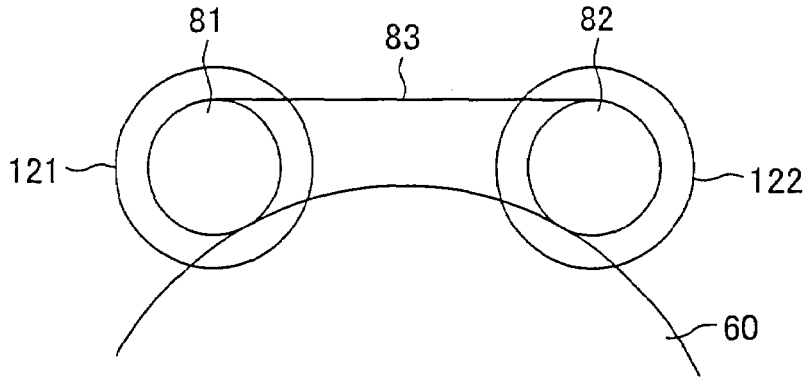
FIGS. 5(*a*) to 5(*c*) are explanatory drawings each of which illustrates a state in which an endless belt of the fixing apparatus according to one embodiment of the present invention is suspended.
Figure 5:
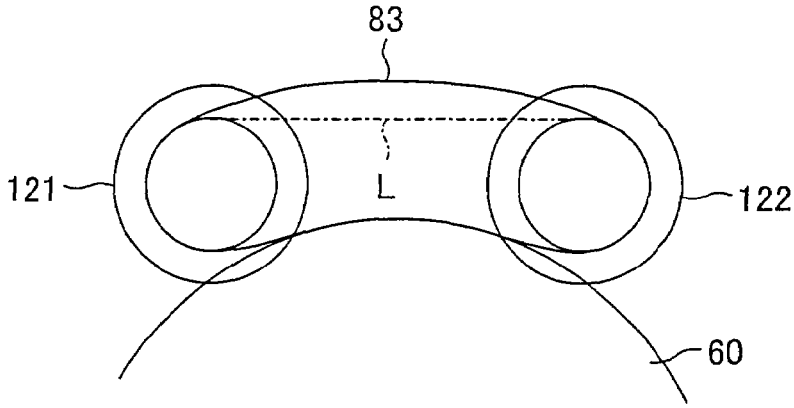
Figure 5:
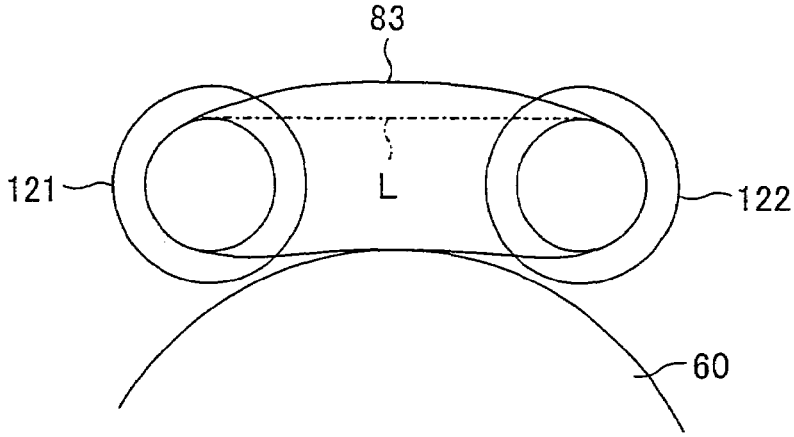

FIG. 5(*a*) illustrates a state of the rotation of the endless belt 83 in case where the support rollers 81 and 82 are in the first position. FIG. 5(*b*) illustrates a state of the rotation of the endless belt 83 in case where the separation distance of the fulcrum 114 (distance by which the support rollers 81 and 82 are moved from the first position to the second position) is 1.5 mm and the support rollers 81 and 82 are disposed in the second position. FIG. 5(*c*) illustrates a state of the rotation of the endless belt 83 in case where the separation distance of the fulcrum 114 is 3.5 mm and the support rollers 81 and 82 are disposed in the second position.

As illustrated in FIG. 5(*a*), in case where the support rollers 81 and 82 are in the first position, the support rollers 81 and 82 are in contact with the fixing roller 60 via the endless belt 83, and the fixing roller 60 cuts in between the support rollers 81 and 82, so that a tension is exerted to the endless belt 83. As a result, the endless belt 83 is positioned so as to substantially correspond to the common tangent line L on the outside of the support rollers 81 and 82 (the side further away from the fixing roller 60). Further, the endless belt 83 does not run upon (does not overrun on) the belt regulating members 121 and 122 and rotates in a normal manner.

As illustrated in FIG. 5(*b*), in case where the separation distance of the fulcrum 114 is 1.5 mm and the support rollers 81 and 82 are in the second position, the fixing roller 60 is separated from the support rollers 81 and 82, so that the endless belt 83 becomes loose. As a result, the endless belt 83 rotates with it slightly rising from the common tangent line L. Note that, although the endless belt 83 rotates with it slightly rising from the common tangent line L, the endless belt 83 does not run upon the belt regulating members 121 and 122, and the endless belt 83 continuously rotates.

Meanwhile, as illustrated in FIG. 5(*c*), in case where the separation distance of the fulcrum 114 is 3.5 mm and the support rollers 81 and 82 are in the second position, the contact width (heating nip width) between the endless belt 83 and the fixing roller 60 is narrower than the case of FIG. 5(*b*), so that the endless belt 83 is hardly rotated by the fixing roller 60 as the endless belt 83 becomes loose. However, the endless belt 83 slightly rotates, i.e., the endless belt 83 slowly or intermittently rotates due to vibration or the like of the machine. Further, in the state illustrated in FIG. 5(*c*), the endless belt 83 runs upon the belt regulating members 121 and 122 at the time of rotation of the endless belt 83.

A condition under which the endless belt 83 runs upon the belt regulating members 121 and 122 in this manner was studied. As a result, the following condition was found.

Figure 6:
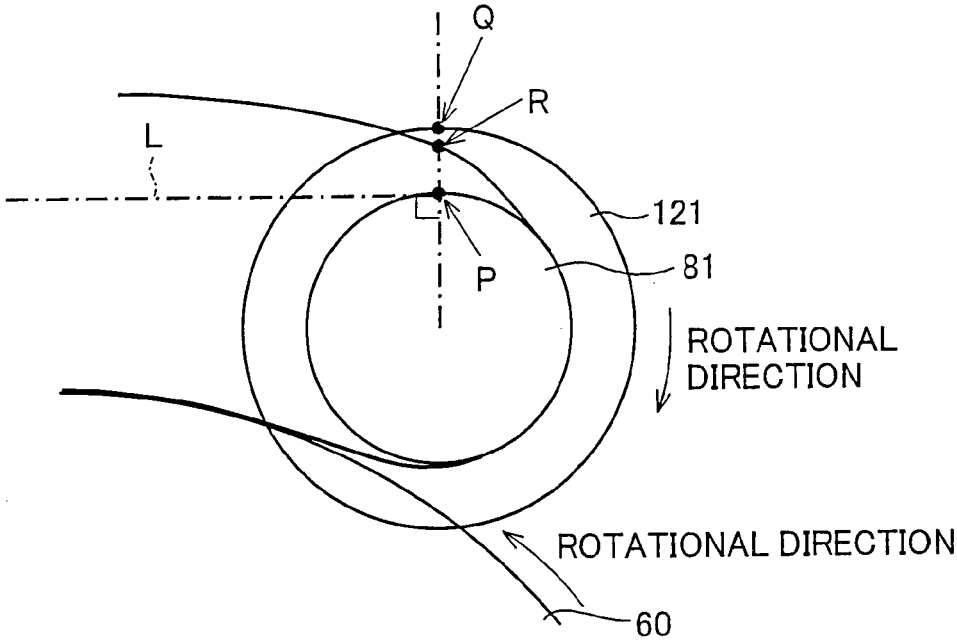
FIG. 6(*a*) illustrates a state in which the belt does not run upon a regulating member even though the support rollers are in the second position in the fixing apparatus according to one embodiment of the present invention.
Figure 6:
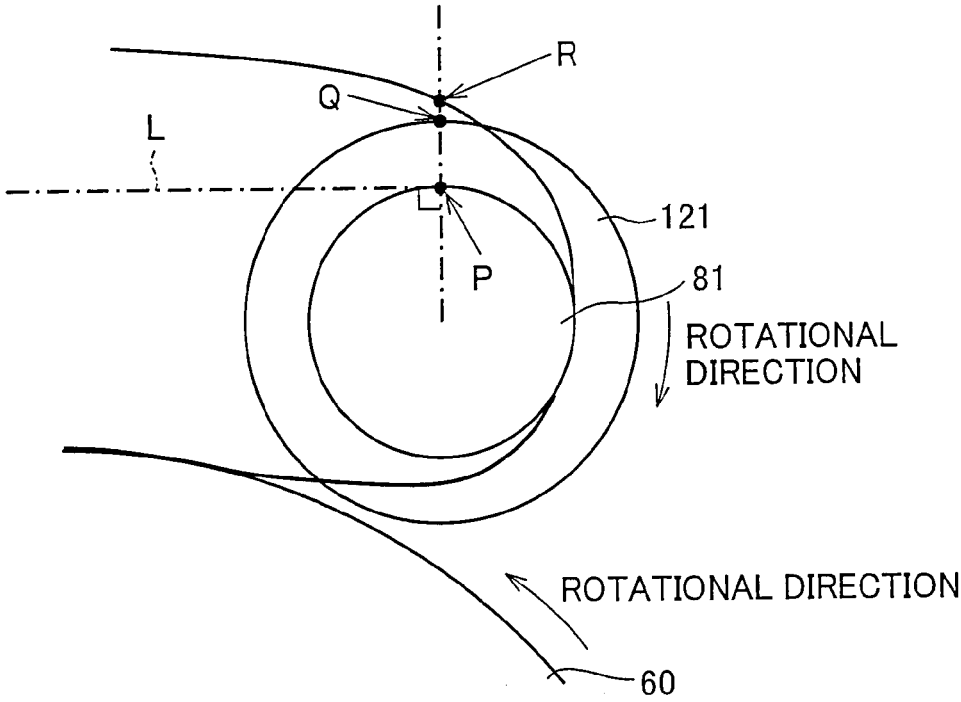

FIG. 6(*a*) illustrates a state in which the endless belt 83 does not run upon the belt regulating members 121 and 122 even if the support rollers 81 and 82 are in the second position. FIG. 6(*b*) illustrates a state in which the endless belt 83 runs upon the belt regulating members 121 and 122 in disposing the support rollers 81 and 82 in the second position.

As illustrated in FIG. 6(*a*), in case where the endless belt 83 at the tangent point P of the external common tangent line L of the support rollers 81 and 82 is separated from the surfaces of the support rollers 81 and 82 by a distance (distance between P and R of FIG. 6(*a*)) smaller than the height H of the belt regulating members 121 and 122 (distance between P and Q of FIG. 6(*a*)) (in case where $P-R<P-Q$) in disposing the support rollers 81 and 82 to the second position, the endless belt 83 does not run upon the belt regulating members 121 and 122.

Meanwhile, as illustrated in FIG. 6(*b*), in case where the endless belt 83 at the tangent point P is separated from the surfaces of the support rollers 81 and 82 by a distance (distance between P and R of FIG. 6(*a*)) longer than the height H of the belt regulating members 121 and 122 (distance between P and Q of FIG. 6(*a*)) (in case where $P-R \geqq P-Q$), the endless belt 83 runs upon the belt regulating members 121 and 122. That is, in case where the endless belt 83 at the tangent point P is positioned in the outside of the peripheral surfaces (position Q of FIG. 6(*b*)) of the belt regulating members 121 and 122, when the endless belt 83 moves in the axis direction of the support rollers 81 and 82, the belt regulating members 121 and 122 fail to regulate the axial position, so that the endless belt 83 twists around the belt regulating members 121 and 122.

Note that, the endless belt 83 runs upon the belt regulating members 121 and 122 due to looseness of the endless belt 83 not only at the time when the support rollers 81 and 82 are disposed in the second position but also while moving from the first position to the second position. That is, even in case where the endless belt 83 is not rotated by the fixing roller 60 in the second position, there is a case where the endless belt 83 rotates at a position in which the endless belt 83 at the junction between the tangent point P and the outside common tangent line L on the surface of the support roller 83 is upwardly deviates so that the deviation corresponds to a distance longer than the height of the belt regulating members 121 and 122 while moving from the first position to the second position, the endless belt 83 may run upon the belt regulating members 121 and 122.

Thus, in case where the distance by which the endless belt 83 at the tangent point P is upwardly deviates is made smaller than the height H of the belt regulating members 121 and 122 so as to rotate the endless belt 83 in the second position or while moving from the first position to the second position, it is possible to prevent the endless belt 83 from running upon the belt regulating members 121 and 122. Note that, the endless belt 83 is likely to run upon the belt regulating members when the endless belt 83 twists around the support rollers. Thus, it is preferable that: in the support roller adjacent to the endless belt 83 in the rotational direction, the height of the belt regulating member on the support roller positioned at least in the downstream side of the endless belt 83 in the rotational direction is made longer than the distance at which the endless belt 83 at the junction of the tangent point P and the outside common tangent line L between the support roller and the adjacent support roller in the second position.

Further, in the present embodiment, when the fixing roller 60 stops rotating, the moving control section 90*c* sets the support rollers 81 and 82 in the second position. Thus, it is possible to suppress or prevent occurrence of temperature unevenness in the surface of the fixing roller 60, thereby obtaining a uniform and high quality image.

That is, the set temperature of the endless belt 83 is higher than the temperature of the fixing roller 60, so that also the temperature of the support rollers 81 and 82 is higher than the temperature of the fixing roller 60. Further, the support roller 81 and 82 has a greater heat capacity than that of the endless belt 83. Thus, in case where the support rollers 81 and 82 are in the first position while the fixing roller 60 stops rotating, a portion (or a vicinity thereof) at which the support rollers 81 and 82 are in contact with the fixing roller 60 via the endless belt 83 has high temperature, so that temperature unevenness occurs in the surface of the fixing roller 60. As a result, the fixed image has uneven gloss, so that the image quality drops. Thus, it is preferable to separate the support rollers 81 and 82 from the fixing roller 60 by setting the support rollers 81 and 82 in the second position while the fixing roller 60 stops rotating so as to suppress or prevent occurrence of the temperature unevenness in the surface of the fixing roller 60.

Note that, in the present embodiment, the endless belt 83 in the second position is partially in contact with the fixing roller 60, but the present invention is not limited to this arrangement. It may be so arranged that the endless belt 83 in the second position is separated from the fixing roller 60. In this case, it is possible to effectively reduce or prevent occurrence of the temperature unevenness in the surface of the fixing roller 60 at the time of stoppage of the rotation.

Figure 7:
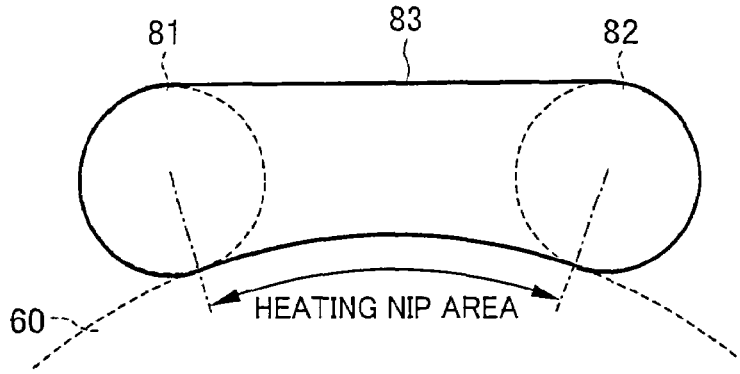
FIGS. 7(*a*) to 7(*c*) are explanatory drawings each of which illustrates a state in which the endless belt and the fixing roller are in contact with each other in the fixing apparatus according to one embodiment of the present invention.
Figure 7:
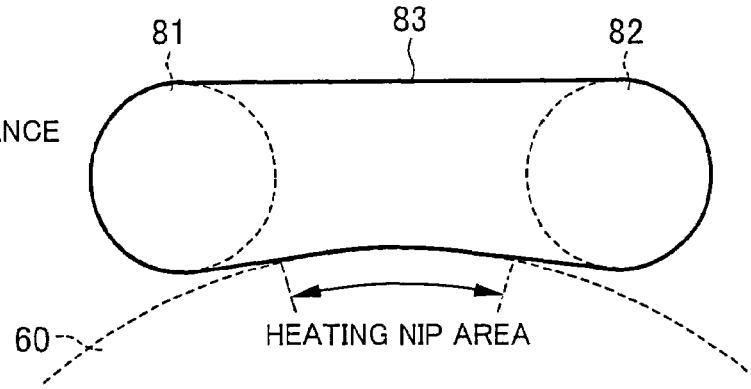
Figure 7:
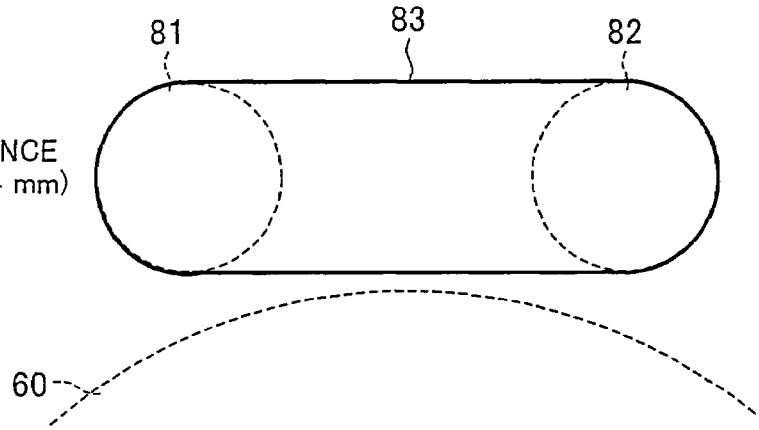

Each of FIGS. 7(*a*) to 7(*c*) illustrates a state in which the endless belt 83 and the fixing roller 60 are in contact with each other in a manner varying depending on the separation distance between the endless belt 83 and the fixing roller 60. FIG. 7(*a*) illustrates a state in which the support rollers 81 and 82 are in the first position. In this case, the heating nip width is large, so that the endless belt 83 is rotated by the fixing roller 60.

FIG. 7(*b*) illustrates a state in which the support rollers 81 and 82 are moved to the second position by setting a distance by which the fulcrum 114 is moved from the first position to the second position to less than 4 mm. In case where the distance by which the fulcrum 114 is moved from the first position to the second position is less than 4 mm, the endless belt 83 is partially in contact with the fixing roller 60 even if the support rollers 81 and 82 are moved to the second position. Note that, when the temperature of the fixing roller 60 is set to 180° C. and the temperature of the support rollers 81 and 82 is set to 220° C. and the rotational speed (peripheral speed) of the fixing roller 60 is set to 355 mm/sec, in case where the distance by which the fulcrum 114 is moved from the first position to the second position is 1.5 mm, the endless belt 83 is rotated by the fixing roller 60. Meanwhile, in case where the distance is set to not less than 2 mm and less than 4 mm, the endless belt 83 is in contact with the fixing roller 60 but in friction with the fixing roller 60, so that the endless belt 83 is not rotated by the fixing roller 60.

In case of FIG. 7(*b*), the support rollers 81 and 82 are not in contact with the fixing roller 60 via the endless belt 83. Thus, When the fixing roller 60 stops rotating, heat of the support rollers 81 and 82 is hardly conducted to the fixing roller 60. However, if the fixing roller 60 is rotated under such condition that the distance by which the fulcrum 114 is moved from the first position to the second position is set to not more than 1.5 mm, the endless belt 83 is rotated by the fixing roller 60, so that heat of the support rollers 81 and 82 is conducted to the fixing roller 60. However, compared with the case of the first position, the contact width (heating nip width) between the endless belt 83 and the fixing roller 60 is narrow, so that heat of the support rollers 81 and 82 is less conducted to the fixing roller 60 than the case of first position. As a result, it is possible to quickly drop the temperature of the fixing roller 60. Further, the endless belt 83 is rotated by the fixing roller 60, so that it is possible to prevent the contact portion between the endless belt 83 and each of the support rollers 81 and 82 from being excessively heated (it is possible to prevent the portion from having excessively high temperature).

FIG. 7(*c*) illustrates a state in which the endless belt 83 is not in contact with and is separated from the fixing roller 60 when the support rollers 81 and 82 are in the second position. In case where the distance by which the fulcrum 144 is moved from the first position to the second position is not less than 4 mm, the endless belt 83 and the fixing roller 60 are not in contact with and are separated from each other in this manner. Thus, heat is not supplied from the external heating device 80 to the fixing roller 60.

Further, in the present embodiment, in case where the temperature of the endless belt 83 and the temperature of the support rollers 81 and 82 are lower than the temperatures at the time of the fixing operation, e.g., in a standby period or in a power-off period, the moving control section 90*c* sets the support rollers 81 and 82 to be in the second position. For example, in case where the temperature detected by the thermistors 86*a* and 86*b* is lower than the temperature for heating the fixing roller 60 to the fixing temperature, the moving control section 90*c* sets the support rollers 81 and 82 to be in the second position. Alternatively, it may be so arranged that: after stopping the rotation of the fixing roller 60 with the endless belt 83 separated from the fixing roller 60, the endless belt 83 is kept separated from the fixing roller 60 with the support rollers 81 and 82 disposed in the second position until the subsequent image formation regardless of the temperature of the endless belt 83.

As a result, it is possible to suppress thermal shrinkage of the endless belt 83 which is caused by lower temperature, thereby suppressing the endless belt 83's tendency to curve which tendency corresponds to shapes of the support rollers 81 and 82 and the endless belt 83. As a result, it is possible to suppress unstable rotation of caused by the tendency.

That is, if the endless belt 83 is left for an extended period of time with a great tension exerted to the endless belt 83, the endless belt 83 has the tendency to curve which tendency corresponds to the shapes of the support rollers 81 and 82. Further, once the endless belt 83 has such tendency, the endless belt 83 slips on the fixing roller 60 even when the fixing roller 60 rotates in beginning the subsequent rotation. In this manner, the endless belt 83 does not smoothly rotate, so that it may be impossible to sufficiently supply heat to the fixing roller 60.

Thus, in case where the temperature of the endless belt 83 is low, the support rollers 81 and 82 are set to be in the second position. The center distance between the support rollers 81 and 82 is fixed, so that a tension of the endless belt 83 suspended by the support rollers 81 and 82 drops, thereby suppressing the endless belt 83's tendency to curve. As a result, it is possible to suppress unstable rotation of the endless belt 83.

Particularly, in wrapping and transporting the fixing apparatus 40 or in such a state that the fixing apparatus 40 is detached from the image forming apparatus 1, the endless belt 83 is kept suspended with the same tension exerted for an extended period of time. As a result, if the tension of the endless belt 83 is kept high, the endless belt 83 apparently has the tendency to curve which is caused by the support rollers 81 and 82. Thus, in wrapping and transporting the fixing apparatus 40 or in such a state that the fixing apparatus 40 is detached from the image forming apparatus 1, it is preferable to make the tension of the endless belt 83 lower than that in the first position by setting the support rollers 81 and 82 in the second position so as to suppress the endless belt 83's tendency to curve. As a result, it is possible to smoothly rotate the endless belt 83 at the time of installation onto the image forming apparatus 1, thereby suitably supplying heat to the fixing roller 60.

Further, in the present embodiment, in beginning the image forming operation in such a state that the temperature of the endless belt 83 is lower than the temperature set at the time of the fixing operation (for example, after the long time standby period, after turning ON the apparatus, or at a similar timing), the moving control section 90*c* moves the support rollers 81 and 82 from the first position to the second position before raising the temperature of the endless belt 83 and the temperature of the support rollers 81 and 82 to the set temperature.

In case where the endless belt 83 is brought into contact with the fixing roller 60 after raising the temperature of the endless belt 83 to the temperature set at the time of the fixing operation, a part of the surface of the fixing roller 60 is sharply heated. Thus, thermal expansion locally occurs, so that members constituting the fixing roller 60 may drop off or may be deteriorated.

In order to solve the problem, the endless belt 83 and the support rollers 81 and 82 are moved to the first position before raising the temperature of the endless belt 83 and the temperature of the support rollers 81 and 82 to the temperature set at the time of the fixing operation (image forming temperature) or to the temperature rise completion temperature and the temperature control section 90*a* turns ON the halogen lamps 86*a* and 86*b* of the support rollers 81 and 82 so as to bring the support rollers 81 and 82 into contact with the fixing roller 60 via the endless belt 83 in such a state that the temperature of the support rollers 81 and 82 is lower than the set temperature, so that it is possible to prevent the surface of the fixing roller 60 from being locally and sharply heated. Further, the fixing roller 60 is heated while raising the temperature of the support rollers 81 and 82 and the temperature of the endless belt 83, so that it is possible to raise the temperature of the fixing roller 60 in a short time, and it is possible to sufficiently supply heat required in the image formation (fixing) to the surface of the fixing roller 60 without delay. Note that, the support rollers 81 and 82 may be moved to the first position after turning ON the halogen lamps 86*a* and 86*b*, or the halogen lamps 86*a* and 86*b* may be turned ON after moving the support rollers 81 and 82 to the first position.

Note that, whether the surface temperature of the fixing roller 60 favorably drops or not and whether the belt is rotated by the fixing roller 60 or not depend on the contact width (heating nip width) between the endless belt 83 and the fixing roller 60, pressure therebetween, and rotational resistance (easiness to rotate) of the endless belt 83. These conditions depend on a surface material, temperature, a peripheral speed of the contact portion, a relation between a belt peripheral length and a center distance, a position of the fulcrum 114, the endless belt 83's tendency to twist (tendency to curve). Thus, it is preferable to determine the separation distance of the fulcrum 114 by suitably adjusting the distance after installing the members of the fixing apparatus 40.

Further, in the belt release/contact operating device 110 according to the present embodiment, the center distance between the support rollers 81 and 82 is fixed by the side frame 111, and the side frame 111 moves, so that it is possible to quickly change the relative distance between (i) the support rollers 81 and 82 and the endless belt 83 and (ii) the fixing roller 60 integrally.

Further, in the present embodiment, the support rollers 81 and 82 are pressed against the fixing roller 60 via the endless belt 83 with a predetermined load when the support rollers 81 and 82 are in the first position. As a result, the endless belt 83 is stably in contact with the fixing roller 60, so that it is possible to rotate the endless belt 83 with stability. Further, the endless belt 83 and the fixing roller 60 are more firmly pressed against each other, so that it is possible to increase heat supplied to the fixing roller 60.

Note that, in the present embodiment, the support rollers 81 and 82 in the first position are pressed against the fixing roller via the endless belt 83. However, the present invention is not limited to this arrangement. It may be so arranged that: in the first position, there is a distance between (i) an external peripheral surface of the endless belt 83 and (ii) the fixing roller 60 so as to be positioned at a winding portion at which the endless belt 83 is in contact with each of the support rollers 81 and 82. Also in this case, the support rollers 81 and 82 are separated further away from the fixing roller 60 in the second position than in the first position. According to this arrangement, the contact area between the fixing roller 60 and the endless belt 83 is smaller in the second position than in the first position, so that it is possible to suppress heat conducted to the fixing roller 60. Further, in case of sheet jam, sudden power-off, blackout, or the like, it is impossible to promptly move the support rollers 81 and 82, so that the support rollers 81 and 82 may be kept in the first position while being at high temperature. Also in this case, according to the foregoing arrangement, the support rollers 81 and 82 are not in contact with the fixing roller 60, so that it is possible to prevent thermal deterioration of the surface releasing layer and the elastic layer which is caused by excessive temperature rise of the fixing roller 60. Further, also in the case where overshoot of the support rollers 81 and 82 occurs, it is possible to prevent thermal deterioration of the surface releasing layer and the elastic layer which is caused by excessive temperature rise of the fixing roller 60.

Further, in the present embodiment, the second position is set so that the endless belt 83 is in contact with the fixing roller 60 also when the support rollers 81 and 82 are moved to the second position.

In case of the arrangement in which the endless belt 83 is completely separated from the fixing roller 60, it is not necessary to increase the distance by which the support rollers 81 and 82 are moved from the first position to the second position. Further, in order to prevent the belt regulating members 121 and 122 in the second position from moving to such a position that the belt regulating members 121 and 122 are in contact with the peripheral surface of the fixing roller 60, it is necessary to increase an external diameter of each of the belt regulating members 121 and 122. However, if the external diameter of each belt regulating member is increased, the belt regulating member interferes between the suspending rollers.

Meanwhile, it is so arranged that the endless belt 83 is in contact with the fixing roller 60 in the second position where the support roller 81 and 82 are positioned furthest from the fixing roller 60 by the belt release/contact operating device 110, so that it is possible to decrease the external diameter of each of the belt regulating members 121 and 122, thereby preventing interference of the belt regulating members 121 and 122 between the support rollers 81 and 82.

Further, the endless belt 83 in the second position is partially in contact with the fixing roller 60, so that it is possible to reduce the distance by which the fulcrum 114 is moved in moving the support rollers 81 and 82 between the first and second positions, thereby reducing the space required in movement of the arm 112, the size of the eccentric cam 113, and the driving force of the eccentric cam 113. As a result, it is possible to realize the smaller size and the reduced power consumption of the fixing apparatus 40. Further, it is possible to promptly move the support rollers 81 and 82 between the first position and the second position.

Note that, if the distance between each of the support rollers 81 and 82 and the fixing roller 60 in the second position is 1 mm or more, it is possible to prevent the surface of the fixing roller 60 from being partially heated by the support rollers 81 and 82. Further, it is possible to make the fixing temperature lower than that in the case where the support rollers 81 and 82 are not separated from the fixing roller 60. Further, if the distance between each of the support rollers 81 and 82 and the fixing roller 60 in the second position is 2 mm or less, the endless belt 83 is rotated by the rotation of the fixing roller 60, so that it is possible to prevent the support rollers 81 ad 82 from partially heating the fixing roller 60.

Further, in the present embodiment, also when the support rollers 81 and 82 are in the second position, the endless belt 83 is rotated upon being in contact with the fixing roller 60. Thus, it is possible to reduce the friction between the fixing roller 60 and the endless belt 83, so that it is possible to prevent abrasion of the endless belt 83 and surface abrasion of the fixing roller 60, and it is possible to suppress the frictional charging. That is, it is possible to prevent the following problem: the endless belt 83 is in contact with the fixing roller 60 while the rotation of the endless belt 83 is being constrained, which results in great friction between both the members, so that surface abrasion and significant frictional charging of surfaces of both the members occur, which results in lower quality of the fixed image.

Further, in the present embodiment, the fixing roller 60 which is in contact with a front surface (recording sheet surface on which the toner image is formed) of the recording sheet has the elastic layer. Thus, it is possible to sufficiently fix the toner image while realizing an appropriate fixing nip width, and it is possible to obtain a uniform and high quality image. Further, it is possible to appropriately strip the recording sheet from the fixing roller 60 even when an amount of the toner is large. Further, it is possible to prevent the temperature of the fixing roller 60 from dropping at the time of sequential output, thereby obtaining high throughput.

Further, in the present embodiment, the pressing roller 70 which is in contact with a rear surface (recording sheet surface on which the toner image is not formed) of the recording sheet has the elastic layer. Thus, it is possible to sufficiently fix the toner image while keeping the fixing nip width. Further, it is possible to prevent the temperature of the pressing roller 70 from dropping at the time of sequential output, thereby obtaining high throughput. Further, it is possible to use a member having high durability as the fixing roller 60 which is in contact with the toner image on the recording sheet, so that it is possible to extend the life of the fixing apparatus 40 (fixing roller 60). Note that, the present embodiment explained the arrangement in which the fixing roller 60 includes the elastic layer. However, the present invention is not limited to this arrangement. For example, it may be so arranged that a hard roller obtained by forming a releasing layer on a metal core without providing any elastic layer is used. Further, it may be so arranged that a hard roller having no elastic layer is used as the pressing roller 70.

Further, in the present embodiment, the moving control section 90*c* moves the support rollers 81 and 82 between the first and second positions so as to change the contact area (heating nip width) between the endless belt 83 and the fixing roller 60, thereby controlling heat supplied from the external heating device 80 to the fixing roller 60.

When the support rollers 81 and 82 are in the first position, the heating nip width increases, so that it is possible to increase heat supplied from the endless belt 83 to the fixing roller 60. Thus, it is possible to prevent the temperature of the fixing roller 60 from dropping in sequentially feeding sheets.

When the support rollers 81 and 82 are in the second position, the heating nip width decreases (or the endless belt 83 is separated from the fixing roller 60), so that it is possible to suppress heat supplied from the endless belt 83 to the fixing roller 60. Thus, for example, it is possible to prevent the following problem: when dropping the set temperature of the fixing roller 60 or when reducing the number of fixed sheets (passing sheets) per certain time, excessive heat is supplied to the fixing roller 60, so that the temperature of the fixing roller 60 becomes higher than the set temperature of the fixing roller 60. Thus, it is possible to prevent (i) hot offset caused by high temperature of the fixing roller 60, (ii) twist of the transfer material (recording sheet), (iii) extraordinary gloss, each of which results in lower quality of the image.

Note that, in the present embodiment, the center distance between the support rollers 81 and 82 is fixed. However, the present invention is not limited to this arrangement. It may be so arranged that the center distance is variable. For example, as illustrated in FIGS. 8(*a*) and 8(*b*), it is so arranged that the center distance between the support rollers 81 and 82 is variable between the first position and the second position, and the support rollers 81 and 82 in the first position are pushed toward the fixing roller 60 with a predetermined pressure (spring force), thereby forming a predetermined heating nip width.

Figure 8:
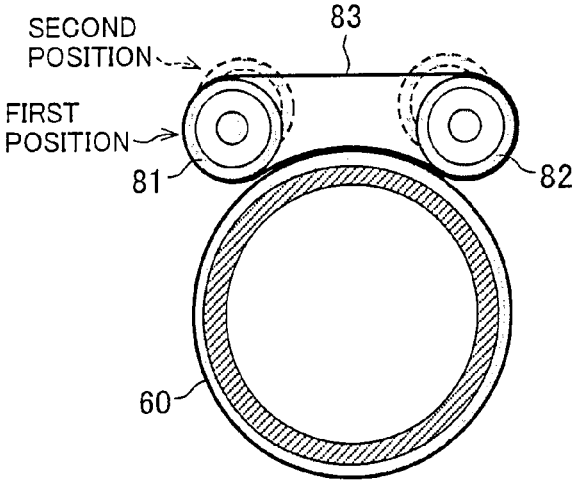
FIGS. 8(*a*) to 8(*c*) are explanatory drawings each of which illustrates an arrangement in which a center distance between the support rollers of the fixing apparatus according to one embodiment of the present invention is variable.
Figure 8:
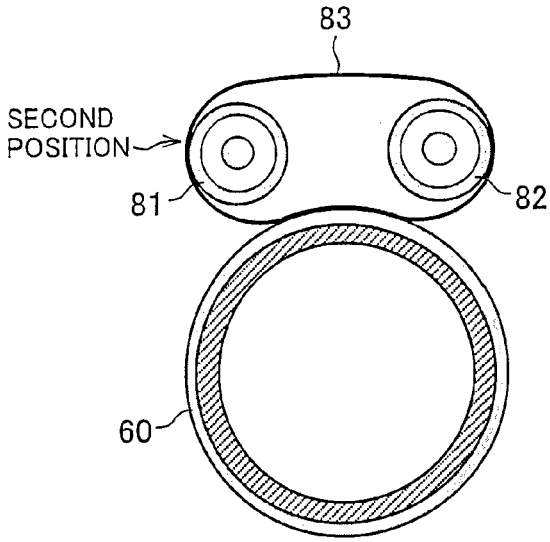
Figure 8:
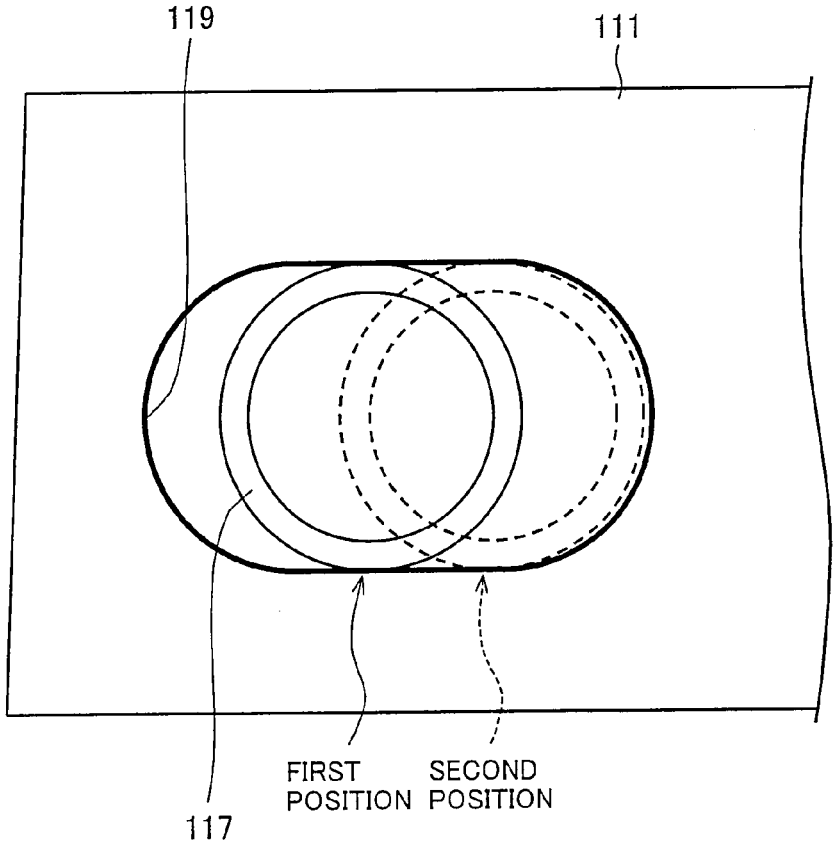

Specifically, as illustrated in FIG. 8(*c*) for example, the bearings 117 and 118 are supported by a long hole 119 provided in the side frame 111 so as to allow the bearings 117 and 118 to be movable within a range of the long hole 119 according to a state of contact (heating nip width) between the endless belt 83 and the fixing roller 60, thereby making the center distance between the support rollers 81 and 82 variable.

In this case, as illustrated in FIG. 8(*a*), in the first position, the support rollers 81 and 82 are in contact with the fixing roller 60 via the endless belt 83, and positions (center distance) of the support rollers 81 and 82 are determined depending on a balance of (i) a tension exerted to the endless belt 83 and (ii) the state of contact between each of the support rollers 81 and 82 and the fixing roller 60 (the state of contact via the endless belt 83).

Meanwhile, in the second position, the support rollers 81 and 82 are separated from the fixing roller 60, so that the bearings 117 and 118 move in a direction in which the center distance is narrowed along the long hole 119 due to the tension of the endless belt 83, and the bearing 117 and 118 come into contact with an end of the long hole 119, thereby determining the center distance between the support rollers 81 and 82 as illustrated in FIG. 8(*b*). Thus, the bearings 117 and 118 are in contact with the long hole 119 of the side frame 111 with the endless belt 83 being loose, so that the positions of the support rollers 81 and 82 are determined.

In case where the center distance between the support rollers 81 and 82 is fixed, the support rollers 81 and 82 cannot be brought into contact with the fixing roller 60 via the endless belt 83 unless the pressure with which the endless belt 83 is pressed against the fixing roller 60, the tension exerted to the endless belt 83, the center distance between the support rollers 81 and 82, and the surface curvature of the fixing roller 60 are balanced. Further, in case where the support rollers 81 and 82 are not in contact with the fixing roller 60, heat is less conducted from the external heating device 80 to the fixing roller 60. While, if the center distance is made variable in the foregoing manner, it is possible to press the support roller 81 and 82 against the fixing roller 60 via the endless belt 83 in the first position without fail, so that it is possible to appropriately carry out the heat conduction.

Further, as illustrated in FIG. 8(*b*), it is possible to realize a state in which the tension of the endless belt 83 is hardly exerted and is loose in the second position, so that it is possible to prevent occurrence of the tendency to curve (tendency to deform) in the endless belt 83 even in case where the endless belt 83 is left for an extended period of time.

Further, in the present embodiment, the two support rollers 81 and 82 are provided, and external diameters of the support rollers 81 and 82 are equal to each other, and the halogen lamps (heating elements) 86*a* and 86*b* are respectively provided in the support rollers 81 and 82. However, the present invention is not limited to this arrangement. The present invention is applicable to an external heating belt type fixing apparatus arranged in any manner. For example, three or more support rollers may be provided. Further, external diameters of the support rollers may be different from each other. Furthermore, a support roller having no heating element may be provided. The heating element may be provided in a position other than the inside of each support roller. Further, it may be so arranged that no support rollers (belt suspending rollers) are pressed against the fixing roller 60 at the time of the fixing operation and only the endless belt 83 is in contact with the fixing roller 60.

Embodiment 2

Another embodiment of the present invention is described as follows. Note that, for convenience in description, the same reference numerals as Embodiment 1 are given to members having the same functions as those of the members described in Embodiment 1, and descriptions thereof are omitted.

The present embodiment is different from Embodiment 1 in that there is provided an external heating device for heating the peripheral surface of the pressing roller 70. That is, the fixing apparatus 40 according to the present embodiment includes the external heating device for coming into contact with the peripheral surface of the pressing roller 70, which is in contact with the rear surface (surface having no unfixed image thereon) of the recording sheet, at the fixing nip section, so as to heat the peripheral surface of the pressing roller 70.

Figure 9:
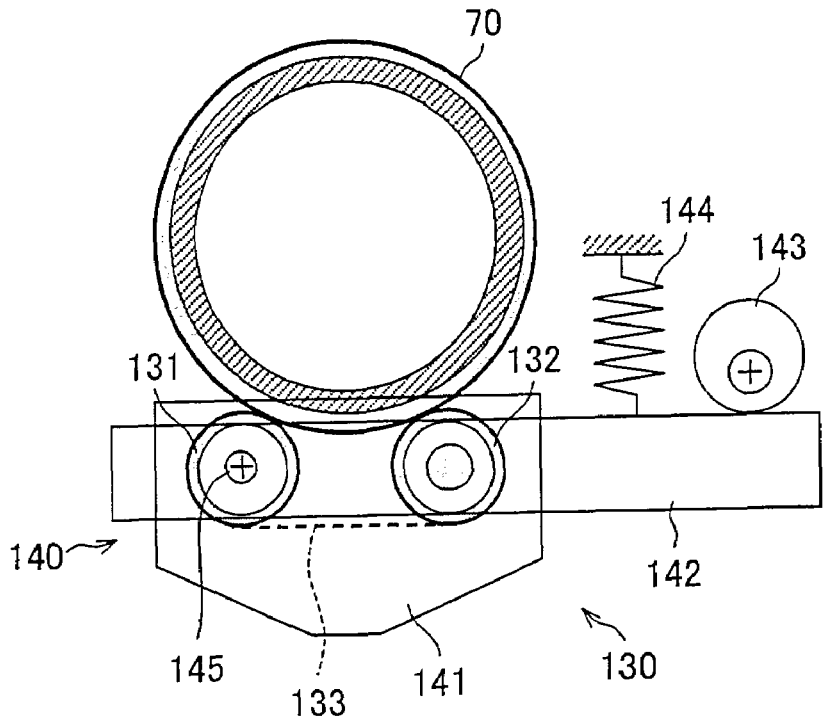
FIGS. 9(*a*) and 9(*b*) are explanatory drawings each of which illustrates an arrangement of a fixing apparatus according to another embodiment of the present invention.
Figure 9:
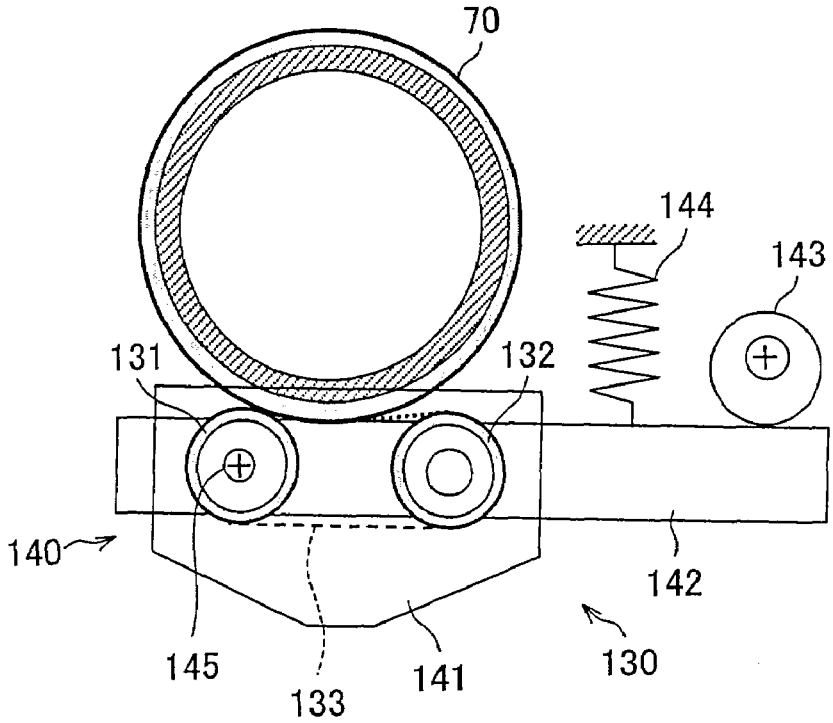
Figure 10:
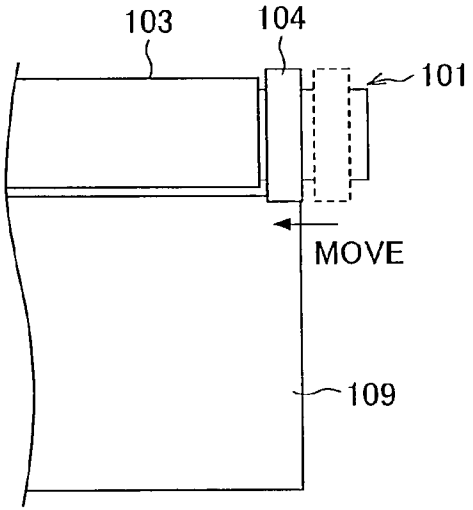
FIGS. 10(*a*) to 10(*d*) are explanatory drawings each of which illustrates an arrangement of a conventional external heating device in which a regulating member for regulating a side position of a belt is provided on each of belt suspending rollers.
Figure 10:
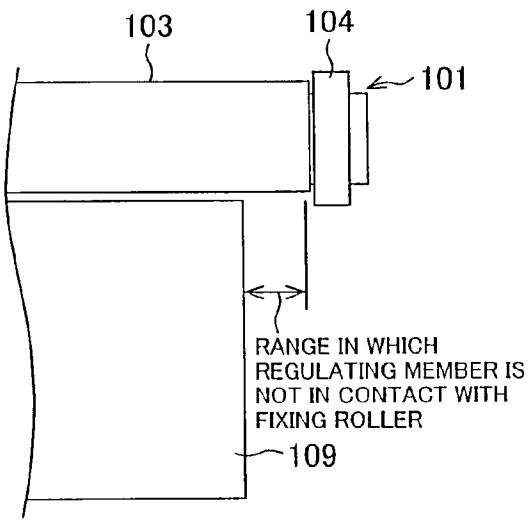
Figure 10:
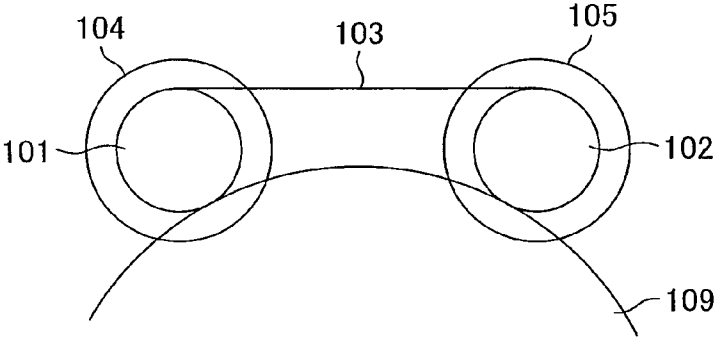
Figure 10:
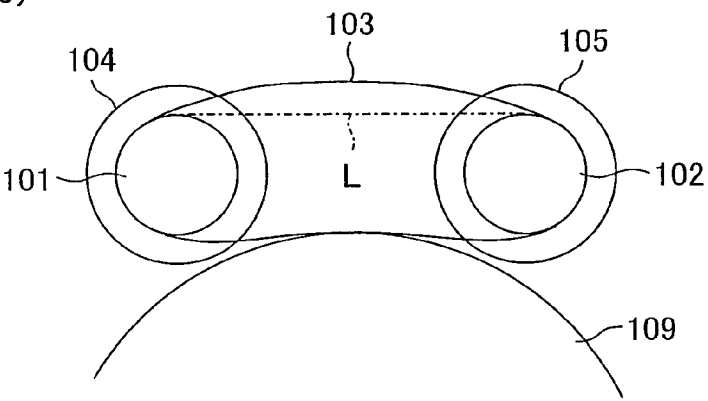

Each of FIGS. 9(*a*) and 9(*b*) illustrates an arrangement of the pressing roller 70 and the external heating device 130 for heating the peripheral surface of the pressing roller 70. Note that, FIG. 9(*a*) illustrates a case where a support roller 132 provided on the external heating device 130 is in a below-described first position. FIG. 9(*b*) illustrates a case where the support roller 132 is in a below-described second position.

As illustrated in FIGS. 9(*a*) and 9(*b*), the external heating device 130 includes a first support roller 131, the second support roller (heating roller) 132, an endless belt 133, and a belt release/contact operating device (release/contact operating device) 140.

The endless belt 133 is suspended by the support rollers 131 and 132 so that a rear side of the endless belt 133 is in contact with peripheral surfaces of the support rollers 131 and 132. The endless belt 133 is provided on the upstream side of the fixing nip section in a rotational direction of the pressing roller 70. When the support roller 132 is in the below-described first position, the support roller 132 is pressed against the pressing roller 70 with a predetermined pressure (40N in the present embodiment). As a result, a heating nip section (a contact portion between the endless belt 133 and the pressing roller 70: its width in a peripheral direction of the pressing roller 70 is 20 mm) is formed between the endless belt 133 and the pressing roller 70.

Further, the endless belt 133 comes into contact with the peripheral surface of the pressing roller 70 which is rotating, so that the endless belt 133 is rotated by the pressing roller 70. As a result, the support rollers 131 and 132 rotate in a direction (K direction in FIG. 3) opposite to the rotational direction of the pressing roller 70. That is, when the control device 90 controls the rotation driving device 91 of the fixing roller 60 so as to rotate the fixing roller 60, the pressing roller 70 is rotated by the fixing roller 60, and a frictional force of a portion at which the endless belt 133 and the pressing roller 70 are in contact with each other causes the endless belt 133 to be rotated and moved by the pressing roller 70, so that the support rollers 131 and 132 and the endless belt 133 rotate.

The endless belt 133 and the support rollers 131 and 132 are arranged in the same manner as the endless belt 83 and the support rollers 81 and 82 which are provided on the external heating device 80 of Embodiment 1. However, no halogen lamp is provided in the support roller 131, and a halogen lamp is provided in the support roller 132. Note that, a temperature detector (not shown) is provided on an external peripheral surface of the endless belt 133 so as to be positioned in the contact portion with respect to the support roller 132, and the control device 90 controls (i) power supplied to the halogen lamp provided in the support roller 132, (ii) a position to which the support rollers 131 and 132 are moved by the belt release/contact operating device 140, (iii) and the like, in accordance with a detection result of the temperature detector.

The belt release/contact operating device 140 presses the support rollers 131 and 132 against the peripheral surface of the pressing roller 70 via the endless belt 133 with a predetermined load. As a result, the surface of the endless belt 133 comes into contact with the peripheral surface of the pressing roller 70, so that a nip section (heating nip section) is formed between the surface of the endless belt 133 and the peripheral surface of the pressing roller 70. Note that, the heating nip width between the surface of the endless belt 133 and the peripheral surface of the pressing roller 70 is 20 mm (width along the peripheral direction of the pressing roller 70).

The belt release/contact operating device 140 includes a side frame 141, an arm 142, an eccentric cam 143, a coil spring 144, and a fulcrum (fulcrum member) 145.

The side frame 141 is provided on each end of the support rollers 131 and 132 and rotatably supports the support rollers 131 and 132 via bearings (not shown). Note that, as in the bearings 117 and 118 provided on the external heating device 80 of Embodiment 1, a center distance between the bearings may be fixed or may be variable.

Further, the side frame 141 is fixed on the arm 142. The arm 142 is supported by a frame (not shown) of the fixing apparatus 40 via the fulcrum 145 so as to be rotatable in a direction substantially perpendicular to an axis direction of the support rollers 131 and 132. Note that, the fulcrum 145 is provided in a position corresponding to a rotational axis of the support roller 131. Thus, even when the arm 142 is rotated around the fulcrum 145, the position of the support roller 131 (the center distance between the support roller 131 and the pressing roller 70) does not change. The center distance between the support roller 131 and the pressing roller 70 is set so that both the rollers are pressed against each other via the endless belt 133 with a predetermined pressure. Further, the coil spring 144 is provided on the arm 142 so as to be positioned opposite to the fulcrum 145 with the support roller 132 intervening therebetween, and the coil spring 144 pushes the side frame 141 provided on the arm 142 toward the pressing roller 70.

The eccentric cam 143 is provided so as to be in contact with a vicinity of an end portion of the arm 142. The control device 90 controls driving means (not shown) such as a motor and the like so as to rotate the eccentric cam 143. As a result, the control device 90 controls the driving means so as to rotate the eccentric cam 143, so that the support rollers 131 and 132 are pressed against the pressing roller 70 by moving the support roller 132 to the first position as illustrated in FIG. 9(*a*), or the eccentric cam 143 is further rotated by 180° and the support roller 132 is moved to the second position as illustrated in FIG. 9(*b*) so as to separate the support roller 132 from the pressing roller 70. Note that, the support roller 131 is pressed against the pressing roller 70 also in the second position.

Note that, as in the belt regulating members 121 and 122 provided on the external heating device 80 of Embodiment 1, a belt regulating member (not shown) is provided between the support roller 131 and the bearing provided on each side of the support roller 131, and a belt regulating member (not shown) is provided between the support roller 132 and the bearing provided on each side of the support roller 132. That is, the belt regulating members each having height which extends from the peripheral surface of each of the support rollers 131 and 132 and which is longer than a distance between each of the support rollers 131 and 132 and the pressing roller 70 in the second position are provided on the support rollers 131 and 132 respectively so as to be positioned on their each side in the axis direction of the support rollers 131 and 132.

As described above, in the present embodiment, out of the two support rollers 131 and 132, the halogen lamp is provided only in the support roller 132, and the belt release/contact operating device 140 allows the support roller 132 having the halogen lamp therein to be in contact with the pressing roller 70 via the endless belt 133 or to be separated from the pressing roller 70.

Thus, the moving control section 90*c* provided in the control device 90 controls the position of the support roller 132 (position relative to the pressing roller 70), thereby controlling heat supplied to the pressing roller 70. For example, by disposing the support roller 132 in the second position, it is possible to promptly drop the surface temperature of the pressing roller 70, and it is possible to reduce surface temperature unevenness of the pressing roller 70.

Note that, in case of sequentially printing images on a small number of recording sheets such as 1 to 5 sheets for example, the moving control section 90*c* may set the support roller 132 to the second position. As a result, it is possible to prevent excessive temperature rise of the pressing roller 70, thereby preventing disadvantage such as lower quality of images.

That is, in case of printing images on a small number of recording sheets, a ratio of time taken for the recording sheet to actually pass through the fixing nip is small in a period from the beginning of the image formation operation to the completion of the sheet delivery. Thus, the temperature of the pressing roller 70 which is pressed against the fixing roller 60 having high temperature so as to rotate is likely to rise. If a wide area of the external heating device 130 is in contact with the pressing roller 70 (the support roller 131 is set to be in the first position) under this condition, the temperature of the pressing roller 70 rises so as to be higher than the temperature set in the fixing operation (the temperature rises to about 160° for example). If such excessive temperature rise occurs, the image is excessively glossy, which results in minute hot offset or lower quality image. Particularly, in case of both-side printing in which a toner image is formed on a first surface of the recording sheet and then a second image is formed on a second surface of the recording sheet, the first surface on which the toner image has first formed is in contact with the pressing roller 70 in fixing the image on the second surface. At this time, if the temperature of the pressing roller 70 is excessively high, the image on the first surface is excessively glossy and glaring, which results in lower quality image.

Thus, the moving control section 90*c* causes the support roller 132 to be in the first position in sequentially feeding six or more sheets for example so as to increase the contact area between the endless belt 83 and the pressing roller 70 and causes the support roller 132 to be in the second position in forming images on five or less sheets so as to prevent excessive temperature rise of the pressing roller 70, thereby preventing the quality of the image from dropping.

Further, the moving control section 90*c* may move the support roller 132 to the second position in carrying out the both-side printing. In fixing the image on the second surface at the time of the both-side printing, the fixing operation carried out with respect to the first surface causes the temperature of the recording sheet to be high. Thus, in the fixing operation carried out with respect to the second surface, heat less shifts from the pressing roller 70 to the recording sheet than in the fixing operation carried out with respect to the first surface. Thus, by moving the support roller 132 to the second position at the time of the both-side printing, it is possible to decrease the contact area between the endless belt 133 and the pressing roller 70, thereby preventing excessive temperature rise of the pressing roller 70.

Further, only the support roller 132 out of the two support rollers 131 and 132 is separated, so that it is possible to decrease a distance by which the arm 142 moves, thereby reducing a size of the fixing apparatus 140 and reducing power consumption of the belt release/contact operating device (detaching mechanism) 130.

Further, the support arm 131 is always pressed against the pressing roller 70 with a predetermined pressure, so that the endless belt 133 is rotated by the pressing roller 70 without fail regardless of the position of the arm 142.

Further, the support arm 131 is always pressed against the pressing roller 70 regardless of the position of the arm 142, so that it is possible to prevent the belt regulating member provided on each side of the support roller 131 from moving to a position where the regulating member is in contact with the peripheral surface of the pressing roller 70 even when the support roller 132 is moved to the second position.

Note that, it is not necessary to provide the belt regulating members so as to respectively correspond to both the support rollers 131 and 132. However, in case of providing the belt regulating member on each side of the support roller 132, it is preferable that the belt regulating member has height from the surface of the support roller 132 which height is longer than the distance between the pressing roller 70 and the support roller 132 in the second position. As a result, it is possible to surely prevent the belt regulating member from moving to the position where the belt regulating member is in contact with the peripheral surface of the pressing roller 70.

Further, in the respective embodiments, the external heating device is provided either the fixing roller 60 (at the fixing nip section, the roller is in contact with the surface of the recording sheet which surface has an unfixed toner image thereon) or the pressing roller 70 (at the fixing nip section, the roller is in contact with the surface of the recording sheet which surface has no unfixed toner image thereon). However, external heating devices may be respectively provided on the fixing roller 60 and the pressing roller 70. In case of providing the external heating devices on the fixing roller 60 and the pressing roller 70 respectively, it is possible to highly accurately control the surface temperatures of both the fixing roller 60 and the pressing roller 70 at the time of sequential sheet feeding and at the time of standby. As a result, it is possible to stably obtain a high quality image and it is possible to continuously obtain high throughput.

Further, the external heating device 130 of Embodiment 2 may be used instead of the external heating device 80 of Embodiment 1, or the external heating device 80 of Embodiment 1 may be used instead of the external heating device 130 of Embodiment 2.

Further, in the present embodiment, the image forming apparatus is arranged so as to transport sheets by using the transport belt, but the image forming apparatus is not limited to this arrangement. The present invention is applicable to an electrophotographic image forming apparatus. For example, the image forming apparatus may be arranged so that an intermediate transfer belt is used or may be arranged so that an image is transferred from the photoreceptor to the recording sheet. Further, the image forming apparatus may form a monochrome image or may form a multicolor image.

Further, in the respective embodiments, the control device 90 includes a control integrated circuit substrate, but the control device 90 is not limited to this arrangement. It may be so arranged that a processor such as a CPU and the like is used to realize functions of the control sections of the control device 90 by software. In this case, for example, the control device 90 includes: a CPU (central processing unit) for carrying out a command of a control program for realizing the functions; a ROM (read only memory) in which the program is stored; a RAM (random access memory) for developing the program; a storage device (storage medium), such as a memory, in which the program and various kinds of data are stored; and the like. Further, the object of the present invention can be achieved as follows: a storage medium for computer-readably storing a program code (an execute form program, intermediate code program, or source program) of the control program of the control device 90 which control program is software for implementing the aforementioned functions is provided to the control device 90, and a computer (or CPU and MPU) provided on the control device 90 reads out the program code stored in the storage medium so as to implement the program, thereby achieving the object of the present invention.

Examples of the storage medium which satisfies these conditions include: tapes, such as magnetic tape and cassette tape; disks including magnetic disks, such as floppy disks® and hard disk, and optical disks, such as CD-ROMs, magnetic optical disks (MOs), mini disks (MDs), digital video disks (DVDs), and CD-Rs; cards, such as IC card (including memory cards) and optical cards; and semiconductor memories, such as mask ROMs, EPROMs, EEPROMs, and flash ROMs.

Further, it may be so arranged that: the control device is made connectable to communication networks, and the program code is supplied via the communication networks. The communication networks are not limited to a specific means. Specific examples of the communication network include Internet, intranet, extranet, LAN, ISDN, VAN, a CATV communication network, a virtual private network, a telephone line network, a mobile communication network, a satellite communication network, and the like. Further, a transmission medium constituting the communication network is not particularly limited. Specifically, it is possible to use a wired line such as a line in compliance with IEEE1394 standard, a USB line, a power line, a cable TV line, a telephone line, an ADSL line, and the like, as the transmission medium. Further, it is possible to use (i) a wireless line utilizing an infrared ray used in IrDA and a remote controller, (ii) a wireless line which is in compliance with Bluetooth standard® or IEEE802.11 wireless standard, and (iii) a wireless line utilizing HDR, a mobile phone network, a satellite line, a ground wave digital network, and the like, as the transmission medium. Note that, the present invention can be realized by a computer data signal (data signal sequence) which is realized by electronic transmission of the program code and which is embedded in a carrier wave.

Further, in the foregoing embodiments, each of the fixing member (fixing roller) and the pressing member (pressing roller) has a roller shape, but the shape thereof is not limited to this. For example, each of the fixing member and the pressing member may have a belt shape.

As described above, a fixing apparatus of the present invention includes: a fixing member; a pressing member; and one or more external heating devices for heating and bringing a belt rotatably suspended by a plurality of support rollers into contact with a peripheral surface of the fixing member or the pressing member which serves as a heated member so as to heat the heated member, the fixing member and the pressing member transporting a recording material by sandwiching the recording material so that an unfixed image on the recording material is fixed onto the recording material with heat and pressure, said fixing apparatus comprising: a release/contact operating device for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position; and a regulating member which is provided on the support rollers so as to be positioned axially in an outside of a region facing to the heated member and is in contact with an edge portion of the belt for regulating a position in an axial direction of the belt, wherein when said at least one support roller is in the second position, the regulating member has a height from a surface of the region facing to the heated member on the support roller so that the height is longer than a distance between a surface of the support roller having the regulating member and a surface of the heated member.

According to the arrangement, the fixing apparatus includes the release/contact operating device for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position. As a result, it is possible to change the contact area (heating nip width) between the belt and the heated member, thereby controlling heat supplied from the external heating device to the heated member.

Further, according to the foregoing arrangement, the fixing apparatus includes the regulating member which is provided on the support rollers so as to be positioned axially in an outside of a region facing to the heated member. As a result, it is possible to regulate an axial position of the belt, thereby smoothly rotating the belt.

Further, the regulating member has a height from a surface of the region facing to the heated member on the support roller so that the height is longer than a distance between a surface of the support roller having the regulating member and a surface of the heated member. Thus, it is possible to prevent the regulating member from moving to the area opposite to the heated member and the support rollers, thereby appropriately controlling the contact area between the belt and the heated member.

Note that, the fixing apparatus may be arranged so that a distance between a peripheral surface of the regulating member and a surface of the belt 5 mm or less when the belt is heated.

In case where both sides of the belt have wide areas which are not in contact with the heated member, each of the areas does not allow heat to be conducted from the belt to the heated member, so that the area has extremely high temperature. As a result, thermal deterioration of the belt is accelerated and the durability of the belt drops, so that contact between the belt and the regulating member may cause breakage of the belt. In contrast, in the foregoing arrangement, the distance between a peripheral surface of the regulating member and a surface of the belt is 5 mm or less when the belt is heated. That is, an axially deviational amount by which the regulating member deviates axially from the counter portion of the belt which counter portion is opposite to the heated member (the axially deviational amount corresponds to a width of the area where the belt and the heated member are not in contact with each other) is up to 5 mm. Thus, it is possible to suppress excessive temperature rise of the belt, thereby keeping sufficient durability of the belt.

Further, the fixing apparatus may be arranged so that the regulating member is rotatable in a rotational direction of the belt.

In case where rotation of the regulating member is constrained, a side portion of the belt and a part of the regulating member are continuously in friction, so that a groove corresponding to the thickness of the belt side portion is formed in the regulating member. Further, the belt rotates while cutting into the groove, so that an excessive stress is exerted to the belt. As a result, the durability of the belt drops. In contrast, according to the foregoing arrangement, the regulating member can rotate in the rotational direction of the belt, so that it is possible to prevent the belt from being in friction with only a part of the regulating member, thereby preventing formation of the groove. As a result, it is possible to prevent the durability of the belt from dropping.

Further, the fixing apparatus may be arranged so that the regulating member is movable in an axial direction of the support roller independently from the support roller.

In case where relative movement of the regulating member in the axial direction of the support roller is constrained, deviation of the support roller in the axial direction or thermal shrinkage of the support roller causes an axial position of the regulating member varies. In contrast, according to the foregoing arrangement, the regulating member is movable in the axial direction of the support roller independently from the support roller, so that it is possible to define an axial position of the belt regardless of the deviation of the support roller or the thermal shrinkage of the support roller, thereby determining relative positions of the heated member and the belt with high accuracy.

Further, a fixing apparatus of the present invention includes: a fixing member; a pressing member; and one or more external heating devices for heating and bringing a belt rotatably suspended by a plurality of support rollers into contact with a peripheral surface of the fixing member or the pressing member which serves as a heated member so as to heat the heated member, the fixing member and the pressing member transporting a recording material by sandwiching the recording material so that an unfixed image on the recording material is fixed onto the recording material with heat and pressure, said fixing apparatus comprising: a release/contact operating device for moving a relative position of at least one support roller out of the support rollers with respect to the heated member between (i) a first position which allows the belt to be in contact with the heated member so that a contact area therebetween corresponds to an area where the belt and the support rollers are not in contact with each other and (ii) a second position which allows the belt to be in contact with the heated member so that the contact area is smaller than in the first position; and a regulating member which is provided on the support rollers so as to be positioned axially in an outside of a region facing to the heated member and is in contact with an edge portion of the belt for regulating a position in an axial direction of the belt, wherein: a center distance between the support rollers is fixed, and there are common tangent lines between a peripheral surface of the support roller having the regulating member and a peripheral surface of a support roller adjacently positioned on an upstream side of that support roller in a rotational direction of the belt so that one of the common tangent lines which is further away from the heated member is a common tangent line L, and the common tangent line L and the peripheral surface of the support roller having the regulating member have a tangent point P, and a distance in a direction perpendicular to the common tangent line L between the tangent point P and the belt in case where said at least one support roller is in the second position is smaller than a height of the regulating member which height extends from the tangent point P to the peripheral surface of the regulating member which is in the direction perpendicular to the common tangent line L.

According to the arrangement, the distance in a direction perpendicular to the common tangent line L between the tangent point P and the belt in case where said at least one support roller is in the second position is smaller than a height of the regulating member which height extends from the tangent point P to the peripheral surface of the regulating member which is in the direction perpendicular to the common tangent line L, so that it is possible to prevent the belt from running upon the regulating member even when the support rollers are moved with the belt rotated or even when the belt is rotated in the second position, thereby realizing appropriate rotation. Thus, it is possible to move the support rollers with the belt rotated, thereby adjusting heat supplied from the belt to the heated member at the same time as the image forming operation. Further, it is not necessary to stop rotation of the heated member in moving the support rollers, so that it is possible to keep the surface temperature of the heated member uniform.

Note that, any one of the aforementioned fixing apparatuses may be arranged so that: a center distance between the support rollers is fixed, and in case where said at least one support roller is in the second position, a peripheral surface of the support roller having the regulating member and a peripheral surface of a support roller adjacently positioned on an upstream side in a rotational direction of the belt with respect to the support roller have a common tangent line, and the common tangent line and the peripheral surface of the support roller having the regulating member have a tangent point, and a distance in a direction perpendicular to the common tangent line between the tangent point and the belt is smaller than a height of the regulating member which height extends from the tangent point to the peripheral surface of the regulating member which is in the direction perpendicular to the common tangent line.

According to the arrangement, it is possible to prevent the belt from running upon the regulating member even when the support rollers are moved with the belt rotated or even when the belt is rotated in the second position, thereby realizing appropriate rotation. Thus, it is possible to move the support rollers with the belt rotated, thereby adjusting heat supplied from the belt to the heated member at the same time as the image forming operation. Further, it is not necessary to stop rotation of the heated member in moving the support rollers, so that it is possible to keep the surface temperature of the heated member uniform.

Further, any one of the aforementioned fixing apparatuses may be arranged so as to include: a rotation driving device for rotating the heated member; and a control section for controlling operations of the release/contact operating device and the rotation driving device, wherein the control section moves the support rollers further away from the heated member than the first position in stopping rotation of the heated member.

The belt and the support members are heated so as to have higher temperature than the heated member. Thus, if the support rollers are kept in the first position with rotation of the heated member stopped, the heated member has high temperature at a portion which is in contact with each support roller via the belt (or a portion of the heated member which portion comes close to the support roller), so that the heated member has temperature unevenness, which may cause uneven gloss in the fixed image. As a result, the quality of the image may drop. In contrast, according to the foregoing arrangement, at the time of rotation stoppage, the support rollers are positioned further away from the heated member than in the case where the support rollers are in the first position, so that it is possible to suppress and prevent occurrence of temperature unevenness of the heated member, thereby obtaining a uniform and high quality image.

Further, the fixing apparatus may be arranged so as to include: a temperature detecting device for detecting a temperature of the belt; and a control section for controlling an operation of the release/contact operating device, wherein the control section moves the support rollers to the second position when the temperature of the belt is equal to or lower than a predetermined temperature which is lower than a temperature for heating the heated member.

According to the arrangement, in case where the temperature of the belt is equal to or lower than the predetermined temperature which is lower than the temperature for heating the heated member, the control section moves the support rollers to the second position. As a result, in the second position, the contact area between the belt and the heated member is small and a tension exerted to the belt is smaller than in the first position, so that it is possible to suppress the belt's tendency to bend corresponding to a shape of the support roller due to thermal shrinkage caused by lower temperature of the belt, thereby suppressing wrong rotation caused by the belt's tendency to bend.

Further, the fixing apparatus may be arranged so as to include a control section for controlling an operation of the release/contact operating device, wherein the control section moves the support rollers to the first position in beginning to heat the heated member and before the belt achieves a temperature for heating the heated member to a fixing temperature.

According to the arrangement, the support rollers are moved to the first position before raising the temperature of the belt to the temperature for heating the heated member so that the heated member has the fixing temperature (temperature which is set at the time of the fixing operation), so that it is possible to suppress local and sudden heating of the surface of the heated member, thereby preventing components of the heated member from being stripped or deteriorated by locally thermal expansion. Further, it is possible to heat the heated member while raising the temperature of the belt, so that it is possible to raise the temperature of the heated member in short time.

Further, the fixing apparatus may be arranged so that the support rollers are pressed against the heated member via the belt in the first position.

According to the arrangement, it is possible to stabilize a condition under which the belt and the heated member are pressed against each other in the first position, so that it is possible to appropriately rotate the belt. Further, it is possible to increase the pressure by which the belt and the heated member are pressed against each other, thereby increasing heat supplied to the heated member.

Further, the fixing apparatus may be arranged so that the belt is partially in contact with the heated member in the second position.

According to the arrangement, a distance by which the support rollers move from the first position to the second position can be made smaller than the case where the belt is completely separated from the heated member in the first position, so that it is possible to reduce the size of the fixing apparatus and it is possible to quickly switch between the first and second positions. Further, a distance between each support roller and the heated member can be made narrower than the case where the belt is completely separated from the heated member in the second position, so that it is possible to reduce the external diameter of the regulating member. Thus, it is possible to prevent the regulating member from interfering with other member (a regulating member provided on the adjacent roller).

According to the foregoing arrangement, the belt is rotatable in the rotational direction of the heated member, so that it is possible to prevent the belt and the heated member from being in friction with each other in case where the rotating heated member and the belt are in contact with each other. Thus, it is possible to suppress abrasion of the belt surface and the heated member surface and to suppress frictional charging of both the members, thereby preventing the abrasion or the frictional charging from deteriorating the quality of the fixed image.

Further, the fixing apparatus may be arranged so that the fixing member is a fixing roller which has an elastic layer and is in contact with the unfixed image on the recording material.

According to the arrangement, the fixing roller having the elastic layer is used, so that it is possible to appropriately secure a width (fixing nip width) of a fixing nip section serving as a contact portion between the fixing member and the pressing roller so as to sufficiently fix the toner image, thereby obtaining a uniform and high quality image. Further, even in case of a large amount of toner, it is possible to easily strip the recording member from the fixing roller. Further, the elastic layer allows the thermal capacity to increase, so that it is possible to prevent the temperature of the fixing roller from dropping at the time of sequential output, thereby obtaining high throughput.

Further, the fixing apparatus may be arranged so that the pressing member is a pressing roller which has an elastic layer and is in contact with an opposite side of the recording material to a side of the unfixed image thereon.

According to the arrangement, the pressing roller having the elastic layer is used, so that it is possible to appropriately secure a width (fixing nip width) of a fixing nip section serving as a contact portion between the pressing roller and the fixing member so as to sufficiently fix the toner image, thereby obtaining a uniform and high quality image. Further, the elastic layer allows the thermal capacity to increase, so that it is possible to prevent the temperature of the fixing roller from dropping at the time of sequential output, thereby obtaining high throughput. Further, the elastic layer of the pressing roller allows a highly durable member can be used as a fixing member which is in contact with the toner image on the recording material, thereby making the life of the fixing apparatus longer.

Further, the fixing apparatus may be arranged so that the number of the external heating devices is two, and one of the external heating devices heats the fixing member, and the other of the external heating devices heats the pressing member.

According to the arrangement, the external heating device can quickly heat the fixing member and the pressing member.

An image forming apparatus of the present invention includes any one of the aforementioned fixing apparatuses. According to the arrangement, it is possible to appropriately control the temperature of the fixing apparatus.

The present invention is not limited to the description of the embodiments above, but may be altered by a skilled person within the scope of the claims. An embodiment based on a proper combination of technical means disclosed in different embodiments is encompassed in the technical scope of the present invention.

Note that, the present invention is applicable to a fixing device provided in an electrophotographic image forming apparatus such as printer, a copying machine, a facsimile, an MFP (Multi Function Printer), and the like.

What is claimed is:

1. A fixing apparatus, including: a fixing member; a pressing member; and one or more external heating devices for heating and bringing a belt rotatably suspended by a plurality of support rollers into contact with a peripheral surface of the fixing member or the pressing member which serves as a heated member so as to heat the heated member; the fixing member and the pressing member transporting a recording material by sandwiching the recording material so that an unfixed image on the recording material is fixed onto the recording material with heat and pressure, said fixing apparatus comprising:

a release/contact operating device for moving a relative position of at least one support roller out of the support rollers with respect to the heated member between (i) a first position which allows the belt to be in contact with the heated member to form a contact area therebetween and (ii) a second position which allows the belt to be in contact with the heated member so that the contact area is smaller than in the first position; and a regulating member which is provided on the support rollers so as to be positioned axially outside of a region facing to the heated member and is in contact with an edge portion of the belt for regulating a position in an axial direction of the belt, wherein when said at least one support roller is in the second position, the regulating member has a height from a surface of the region facing to the heated member on the support roller so that the height is longer than a distance between a surface of the support roller having the regulating member and a surface of the heated member.

2. The fixing apparatus as set forth in claim 1, wherein a distance between a peripheral surface of the regulating member and a surface of the belt is 5 mm or less when the belt is heated.

3. The fixing apparatus as set forth in claim 1, wherein the regulating member is rotatable in a rotational direction of the belt.

4. The fixing apparatus as set forth in claim 1, wherein the regulating member is movable in an axial direction of the support roller independently from the support roller.

5. The fixing apparatus as set forth in claim 1, wherein:

a center distance between the support rollers is fixed, and there are common tangent lines between a peripheral surface of the support roller having the regulating member and a peripheral surface of a support roller adjacently positioned on an upstream side of that support roller in a rotational direction of the belt so that one of the common tangent lines which is further away from the heated member is a common tangent line L, and the common tangent line L and the peripheral surface of the support roller having the regulating member have a tangent point P, and a distance in a direction perpendicular to the common tangent line L between the tangent point P and the belt in case where said at least one support roller is in the second position is smaller than a height of the regulating member which height extends from the tangent point P to the peripheral surface of the regulating member which is in the direction perpendicular to the common tangent line L.

6. The fixing apparatus as set forth in claim 1, comprising:

a rotation driving device for rotating the heated member; and a control section for controlling operations of the release/contact operating device and the rotation driving device, wherein the control section moves the support rollers further away from the heated member than the first position in stopping rotation of the heated member.

7. The fixing apparatus as set forth in claim 1, comprising:

a temperature detecting device for detecting a temperature of the belt; and a control section for controlling an operation of the release/contact operating device, wherein the control section moves the support rollers to the second position when the temperature of the belt is equal to or lower than a predetermined temperature which is lower than a temperature for heating the heated member.

8. The fixing apparatus as set forth in claim 1, comprising a control section for controlling an operation of the release/contact operating device, wherein the control section moves the support rollers to the first position in beginning to heat the heated member and before the belt achieves a temperature for heating the heated member to a fixing temperature.

9. The fixing apparatus as set forth in claim 1, wherein the support rollers are pressed against the heated member via the belt in the first position.

10. The fixing apparatus as set forth in claim 1, wherein the belt is partially in contact with the heated member in the second position.

11. The fixing apparatus as set forth in claim 1, wherein the belt is rotatable in a rotational direction of the heated member in the second position.

12. The fixing apparatus as set forth in claim 1, wherein the fixing member is a fixing roller which has an elastic layer and is in contact with the unfixed image on the recording material.

13. The fixing apparatus as set forth in claim 1, wherein the pressing member is a pressing roller which has an elastic layer and is in contact with an opposite side of the recording material to a side of the unfixed image thereon.

14. The fixing apparatus as set forth in claim 1, wherein the number of the external heating devices is two, and one of the external heating devices heats the fixing member, and the other of the external heating devices heats the pressing member.

15. A fixing apparatus, including: a fixing member; a pressing member; and one or more external heating devices for heating and bringing a belt rotatably suspended by a plurality of support rollers into contact with a peripheral surface of the fixing member or the pressing member which serves as a heated member so as to heat the heated member; the fixing member and the pressing member transporting a recording material by sandwiching the recording material so that an unfixed image on the recording material is fixed onto the recording material with heat and pressure, said fixing apparatus comprising:

a release/contact operating device for moving a relative position of at least one support roller out of the support rollers with respect to the heated member between (i) a first position which allows the belt to be in contact with the heated member to form a contact area therebetween and (ii) a second position which allows the belt to be in contact with the heated member so that the contact area is smaller than in the first position; and a regulating member which is provided on the support rollers so as to be positioned axially outside of a region facing to the heated member and is in contact with an edge portion of the belt for regulating a position in an axial direction of the belt, wherein:

a center distance between the support rollers is fixed, and there are common tangent lines between a peripheral surface of the support roller having the regulating member and a peripheral surface of a support roller adjacently positioned on an upstream side of that support roller in a rotational direction of the belt so that one of the common tangent lines which is further away from the heated member is a common tangent line L, and the common tangent line L and the peripheral surface of the support roller having the regulating member have a tangent point P, and a distance in a direction perpendicular to the common tangent line L between the tangent point P and the belt in case where said at least one support roller is in the second position is smaller than a height of the regulating member which height extends from the tangent point P to the peripheral surface of the regulating member which is in the direction perpendicular to the common tangent line L.

16. The fixing apparatus as set forth in claim 15, comprising:

a rotation driving device for rotating the heated member; and a control section for controlling operations of the release/contact operating device and the rotation driving device, wherein the control section moves the support rollers further away from the heated member than the first position in stopping rotation of the heated member.

17. The fixing apparatus as set forth in claim 15, comprising:

a temperature detecting device for detecting a temperature of the belt; and a control section for controlling an operation of the release/contact operating device, wherein the control section moves the support rollers to the second position when the temperature of the belt is equal to or lower than a predetermined temperature which is lower than a temperature for heating the heated member.

18. The fixing apparatus as set forth in claim 15, comprising a control section for controlling an operation of the release/contact operating device, wherein the control section moves the support rollers to the first position in beginning to heat the heated member and before the belt achieves a temperature for heating the heated member to a fixing temperature.

19. The fixing apparatus as set forth in claim 15, wherein the support rollers are pressed against the heated member via the belt in the first position.

20. The fixing apparatus as set forth in claim 15, wherein the belt is partially in contact with the heated member in the second position.

21. The fixing apparatus as set forth in claim 15, wherein the belt is rotatable in a rotational direction of the heated member in the second position.

22. The fixing apparatus as set forth in claim 15, wherein the fixing member is a fixing roller which has an elastic layer and is in contact with the unfixed image on the recording material.

23. The fixing apparatus as set forth in claim 15, wherein the pressing member is a pressing roller which has an elastic layer and is in contact with an opposite side of the recording material to a side of the unfixed image thereon.

24. The fixing apparatus as set forth in claim 15, wherein the number of the external heating devices is two, and one of the external heating devices heats the fixing member, and the other of the external heating devices heats the pressing member.

25. An image forming apparatus, comprising a fixing apparatus, including: a fixing member; a pressing member; and one or more external heating devices for heating and bringing a belt rotatably suspended by a plurality of support rollers into contact with a peripheral surface of the fixing member or the pressing member which serves as a heated member so as to heat the heated member; the fixing member and the pressing member transporting a recording material by sandwiching the recording material so that an unfixed image on the recording material is fixed onto the recording material with heat and pressure, said fixing apparatus comprising:

a release/contact operating device for moving a relative position of at least one support roller out of the support rollers with respect to the heated member between (i) a first position which allows the belt to be in contact with the heated member to form a contact area therebetween and (ii) a second position which allows the belt to be in contact with the heated member so that the contact area is smaller than in the first position; and a regulating member which is provided on the support rollers so as to be positioned axially outside of a region facing to the heated member and is in contact with an edge portion of the belt for regulating a position in an axial direction of the belt, wherein when said at least one support roller is in the second position, the regulating member has a height from a surface of the region facing to the heated member on the support roller so that the height is longer than a distance between a surface of the support roller having the regulating member and a surface of the heated member.

26. An image forming apparatus, comprising a fixing apparatus, including: a fixing member; a pressing member; and one or more external heating devices for heating and bringing a belt rotatably suspended by a plurality of support rollers into contact with a peripheral surface of the fixing member or the pressing member which serves as a heated member so as to heat the heated member; the fixing member and the pressing member transporting a recording material by sandwiching the recording material so that an unfixed image on the recording material is fixed onto the recording material with heat and pressure, said fixing apparatus comprising:

a release/contact operating device for moving a relative position of at least one support roller out of the support rollers with respect to the heated member between (i) a first position which allows the belt to be in contact with the heated member to form a contact area therebetween and (ii) a second position which allows the belt to be in contact with the heated member so that the contact area is smaller than in the first position; and a regulating member which is provided on the support rollers so as to be positioned axially outside of a region facing to the heated member and is in contact with an edge portion of the belt for regulating a position in an axial direction of the belt, wherein:

a center distance between the support rollers is fixed, and there are common tangent lines between a peripheral surface of the support roller having the regulating member and a peripheral surface of a support roller adjacently positioned on an upstream side of that support roller in a rotational direction of the belt so that one of the common tangent lines which is further away from the heated member is a common tangent line L, and the common tangent line L and the peripheral surface of the support roller having the regulating member have a tangent point P, and a distance in a direction perpendicular to the common tangent line L between the tangent point P and the belt in case where said at least one support roller is in the second position is smaller than a height of the regulating member which height extends from the tangent point P to the peripheral surface of the regulating member which is in the direction perpendicular to the common tangent line L.

* * * * *